US011138933B2

(12) United States Patent
Hsu et al.

(10) Patent No.: US 11,138,933 B2
(45) Date of Patent: Oct. 5, 2021

(54) DISPLAY DEVICE AND OPERATING METHOD THEREOF

(71) Applicant: Au Optronics Corporation, Hsinchu (TW)

(72) Inventors: Ming-Chen Hsu, Hsinchu (TW); Hsiang-Yuan Hsieh, Hsinchu (TW); Min-Yao Lu, Hsinchu (TW); Chin-Tang Chuang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/679,252

(22) Filed: Nov. 10, 2019

(65) Prior Publication Data

US 2020/0193902 A1 Jun. 18, 2020

(30) Foreign Application Priority Data

Dec. 12, 2018 (TW) ..... 107144886

(51) Int. Cl.

| | |
|---|---|
| ***G09G 3/32*** | (2016.01) |
| ***G09G 3/3233*** | (2016.01) |
| ***G09G 3/3258*** | (2016.01) |
| ***G09G 3/34*** | (2006.01) |

(52) U.S. Cl.
CPC ..... *G09G 3/3233* (2013.01); *G09G 3/3258* (2013.01); *G09G 3/3406* (2013.01)

(58) Field of Classification Search
CPC ..... G09G 2320/04; H05B 45/05
See application file for complete search history.

(56) References Cited

U.S. PATENT DOCUMENTS

| | | | | |
|---|---|---|---|---|
| 9,881,544 | B2 | 1/2018 | Qing et al. | |
| 2011/0148306 | A1* | 6/2011 | Ger | H05B 45/44 315/125 |
| 2015/0372052 | A1 | 12/2015 | Bower et al. | |
| 2016/0019836 | A1 | 1/2016 | Qing et al. | |
| 2017/0323592 | A1 | 11/2017 | Hughes et al. | |

FOREIGN PATENT DOCUMENTS

| | | |
|---|---|---|
| CN | 103531149 | 7/2015 |
| CN | 108648687 | 10/2018 |
| TW | I658448 | 5/2019 |

* cited by examiner

*Primary Examiner* — Joseph R Haley
(74) *Attorney, Agent, or Firm* — JCIPRNET

(57) ABSTRACT

A display device and an operating method of the display device are provided. The display device includes a first light emitting diode (LED), a first switch, a second switch, a second LED, a third switch, and a first controller. A first terminal of the first switch receives a first electrical signal. A first terminal of the second switch receives a second electrical signal. A first terminal of the third switch receives a third electrical signal. Here, whether the first switch, the second switch, and the third switch are switched on or off is determined by whether the first LED and the second LED are damaged or not. The first controller is configured to detect whether the first LED and the second LED are damaged or not, generate the second electrical signal and the electrical signal, and generate a plurality of control signals controlling the first switch to the third switch.

16 Claims, 18 Drawing Sheets

100

DISPLAY DEVICE AND OPERATING METHOD THEREOF

CROSS-REFERENCE TO RELATED APPLICATION

This application claims the priority benefit of Taiwan application serial no. 107144886, filed on Dec. 12, 2018. The entirety of the above-mentioned patent application is hereby incorporated by reference herein and made a part of this specification.

BACKGROUND

Technical Field

The disclosure relates to a display device and an operating method thereof; more particularly, the disclosure relates to a display device capable of automatically inspecting dark spots on pixels and compensating for the brightness of the dark spots to ensure that a display image can have uniform brightness and an operating method of the display device.

Description of Related Art

Nowadays, the structure of a micro light emitting diode (micro-LED) driven by a micro integrated circuit can only allow one single pixel to be driven at one time, which limits the time frame during which the pixel can emit light and may lead to the situation where brightness or levels of gray scale is insufficient. Besides, the number of micro-LEDs which can be driven is limited by the size of the micro integrated circuit, and the number of the micro integrated circuit is thus required to be increased. In addition, the wiring manner of the common micro-LED display device driven by the micro integrated circuit is complicated, which poses a limitation to the number of pins, the gate driving circuit and the source driving circuit are all disposed outside, and therefore the effects of applying the micro-LED display device to a spliced panel are not satisfactory.

Hence, according to the existing technology applied to the display device, in order to improve the quality of display images, researches associated with the issue of ensuring uniform brightness and determining and correcting dark spots on pixels as well as compensating for brightness of the dark spots on pixels have been made, and how to ensure the uniform brightness of the display images and also detect and correct the dark spots and compensate for the brightness of the dark spots has become an important topic.

SUMMARY

The disclosure provides a display device and an operating method thereof, which can automatically inspect dark spots on pixels and compensate brightness of the dark spots, so as to ensure the uniform brightness of a display image.

According to an embodiment of the disclosure, a display device includes a first light emitting diode (LED), a first switch, a second switch, a second LED, a third switch, and a first controller. A first terminal of the first switch receives a first electrical signal, and a second terminal of the first switch is coupled to an anode of the first LED. A first terminal of the second switch receives a second electrical signal, and a second terminal of the second switch is coupled to a cathode of the first LED. An anode of the second LED is coupled to the cathode of the first LED. A first terminal of the third switch receives a third electrical signal, and a second terminal of the third switch is coupled to a cathode of the second LED. Here, whether the first switch, the second switch, and the third switch are switched on or off is determined by whether the first LED and the second LED are damaged or not. The first controller is configured to detect whether the first LED and the second LED are damaged or not, generate the second electrical signal and the electrical signal, and generate a plurality of control signals controlling the first switch to the third switch.

According to an embodiment of the disclosure, a display device includes a first LED, a first switch, a second switch, a second LED, a third switch, a fourth switch, and a first controller. A first terminal of the first switch receives a first electrical signal, and a second terminal of the first switch is coupled to an anode of the first LED. A first terminal of the second switch receives a second electrical signal, and a second terminal of the second switch is coupled to the anode of the first LED. An anode of the second LED is coupled to the anode of the first LED. A first terminal of the third switch receives a third electrical signal, and a second terminal of the third switch is coupled to a cathode of the first LED. A first terminal of the fourth switch receives the third electrical signal, and a second terminal of the fourth switch is coupled to a cathode of the second LED. Here, whether the first switch, the second switch, the third switch, and the fourth switch are switched on or off is determined by whether the first LED and the second LED are damaged or not. The first controller is configured to detect whether the first LED and the second LED are damaged or not, generate the second electrical signal and the electrical signal, and generate a plurality of control signals controlling the first switch to the fourth switch.

According to an embodiment of the disclosure, an operating method of a display device includes: during an inspection time period, providing an inspection signal to a first LED and a second LED coupled to each other and determining a damaged state of the first LED and a damaged state of the second LED by detecting a voltage at a point where the first LED and the second LED are coupled; selecting two of a first electrical signal, a second electrical signal, and a third electrical signal according to the determined damaged states and applying the two selected electrical signals respectively to two terminals of the undamaged LED; adjusting an intensity of one of the two selected electrical signals according to the determined damaged states.

In view of the above, the display device controls a plurality of switches through the first controller, so as to detect whether the first LED and the second LED are damaged or not (i.e., detect whether there is any dark spot on pixels due to damages to the LEDs), and a plurality of control signals, the second electric signal, and the third electric signal are provided to the switches according to the damaged states of the first LED and the second LED, so as to compensate for the brightness of the dark spots on the pixels. As such, the effects of automatic inspection and compensation for the dark spots on the pixels can be achieved, and the brightness of the display image is uniform.

To make the above features and advantages provided in one or more of the embodiments of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1:
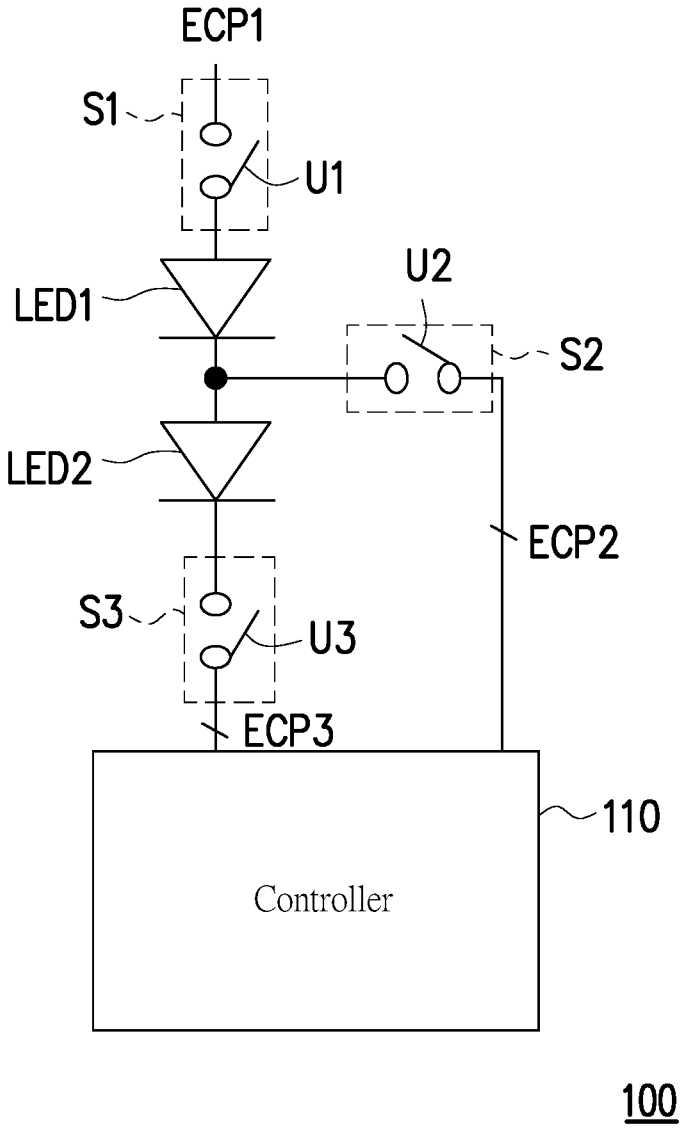
FIG. 1 is a schematic block view illustrating a circuit of a display device according to an embodiment of the disclosure.

In the accompanying drawings, thicknesses of layers, films, panels, regions and so on are exaggerated for clarity. Throughout the specification, the same reference numerals in the accompanying drawings denote the same elements. It should be understood that when an element such as a layer, film, region or substrate is referred to as being "on" or "connected to" another element, it can be directly on or connected to the other element, or intervening elements may also be present. In contrast, when an element is referred to as being "directly on" or "directly connected to" another element, there is no intervening element present. As used herein, the term "connected" may refer to physically connected and/or electrically connected. Besides, "electrical connection" or "coupling" may be referred to as an intervening element existing between two elements.

FIG. 1 is a schematic block view illustrating a circuit of a display device according to another embodiment of the disclosure. A display device 100 includes LED1, LED2, switches S1-S3, and a controller 110. A first terminal of the switch S1 receives an electrical signal ECP1, and a second terminal of the switch S1 is coupled to an anode of the LED1. A first terminal of the switch S2 receives an electrical signal ECP2, and a second terminal of the switch S2 is coupled to a cathode of the LED1. An anode of the LED2 is coupled to the cathode of the LED1. A first terminal of the switch S3 receives an electrical signal ECP3, and a second terminal of the switch S3 is coupled to a cathode of the LED2, wherein whether the switches S1-S3 are switched on or off is determined by whether the LED1 and the LED2 are damaged or not.

In another aspect, the controller 110 is configured to detect whether the LED1 and the LED2 are damaged or not, generate the electrical signal ECP2 and the electrical signal ECP3, and generate a plurality of control signals (e.g., control signals U1-U3) controlling the switches S1-S3. Particularly, the controller 110 of the display device 100 provided in the present embodiment can provide the control signals U1-U3 at an enabling voltage level to switch on the switches S1-S3, so as to detect damaged states of the LED1 and the LED2 according to the voltage on the cathode of the LED1 and respectively provide the control signals U1-U3 to the switches S1-S3 according to the damage states of the LED1 and LED2. As such, in response to the different damaged states of the LED1 and the LED2, the switches S1-S3 are switched on or off, so as to perform a compensation operation on the dark spots on pixels. That is, the LED1, the LED2, and the switches S1-S3 provided herein can be considered as one set of pixel circuit, and the controller 110 is applied to detect the pixel circuit, so as to determine whether there is any dark spot on the pixels due to damages to the LED1 and the LED2 and whether the compensation operation on the dark spots on pixels is required.

To be specific, please refer to FIG. 1 and FIG. 2A to FIG. 2D. FIG. 2A to FIG. 2D schematically illustrate circuit operations of the display device depicted in FIG. 1 while the damaged states of the LEDs are different. According to the present embodiment, the switches S1-S3 of the display device 100 can be implemented in form of p-type transistors as an exemplary embodiment, which should however not be construed as a limitation in the disclosure, and the switches can also be implemented in form of n-type transistors. In the present embodiment, the electrical signal ECP1 can be, for instance, a system voltage OVDD, which should however not be construed as a limitation in the disclosure. First, in an inspection time period, the controller 110 provides the control signals U1-U3 at the enabling voltage level to switch on the switches S1-S3 and determines whether the LED1 and the LED2 are damaged or not according to a voltage on the cathode of the LED1.

For instance, when the controller 110 detects that the voltage on the cathode of the LED1 is obtained by subtracting the voltage at which the LED1 is switched on from the system voltage OVDD, it indicates that the LED1 and the LED2 are both in the normal state (i.e., not in the damaged state); when the controller 110 detects that the voltage on the cathode of the LED1 is the system voltage OVDD, it indicates that the LED1 is in the damaged state, while the LED2 is in the normal state; when the controller 110 detects that the voltage on the cathode of the LED1 is zero, it indicates that the LED2 is in the damaged state, and the LED1 is in the normal state. Here, the damaged state may refer to an open circuit (or short circuit) due to damages to the LEDs, for instance. Thereby, the controller 110 can be applied to automatically and instantly detect the voltage on the cathode of the LED1, so as to perform the automatic inspection while there is any damage to the LED1 and the LED2 and carry out the compensation operation on the dark spots on pixels.

Figure 2A:
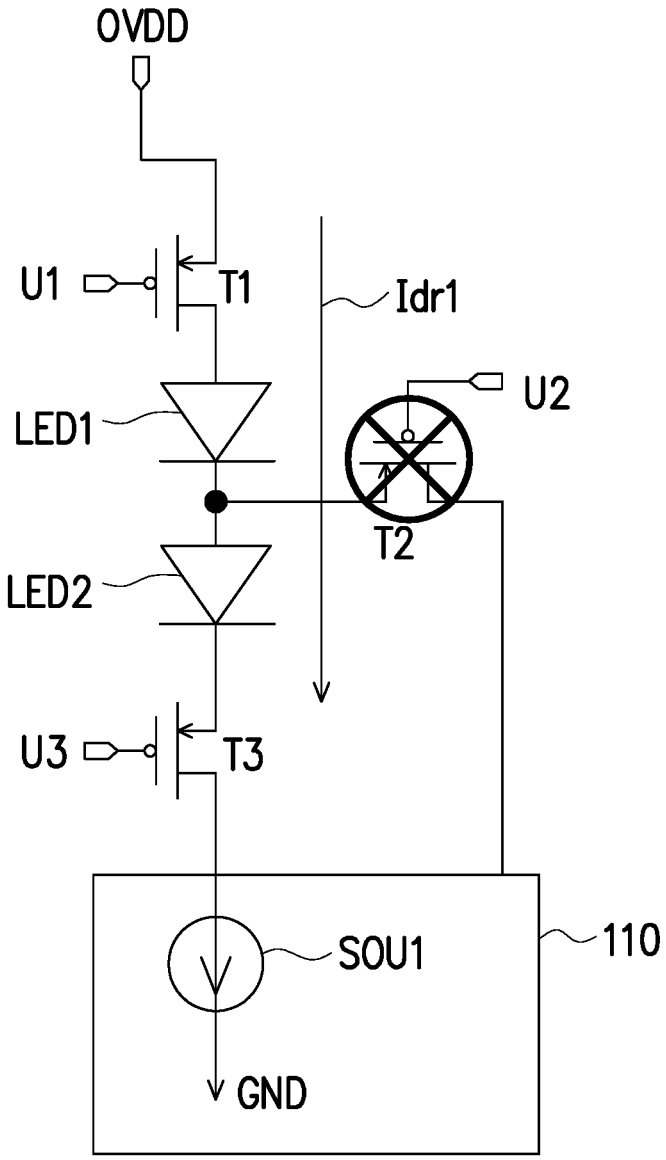
FIG. 2A to FIG. 2D schematically illustrate circuit operations of the display device depicted in FIG. 1 while the damaged states of LEDs are different.

While the LEDs are in different damaged states, the circuit operations of the display device 100 are elaborated hereinafter. Please refer to FIG. 1 and FIG. 2A. FIG. 2A illustrates the circuit operation of the display device depicted in FIG. 1 while the LED1 and the LED2 are both undamaged. When the controller 110 determines that the LED1 and the LED2 are both in the normal state, the transistor T1 is switched on according to the control signal U1 at the enabling voltage level, the transistor T3 is switched on according to the control signal U3 at the enabling voltage level, and the transistor T2 is switched off according to the control signal U2 at a disabling voltage level. Meanwhile, the controller 110 provides the electrical signal ECP3 to the first terminal of the transistor T3, so as to generate a driving current Idr1 to drive the LED1 and the LED2, wherein the electrical signal ECP3 is a drain current SOU1 which is current sink type, one terminal of the drain current SOU1 is coupled to the first terminal of the transistor T3, while the other terminal is coupled to a reference ground voltage GND. That is, the controller 110 at this time generates the driving current Idr1 through providing the drain current SOU1, so that the driving current Idr1 simultaneously switches on the transistor T1 and the transistor T3 to drive the LED1 and the LED2 and enable the LED1 and the LED2 to have substantially the same brightness, whereby the display image can have the uniform brightness.

Figure 2B:
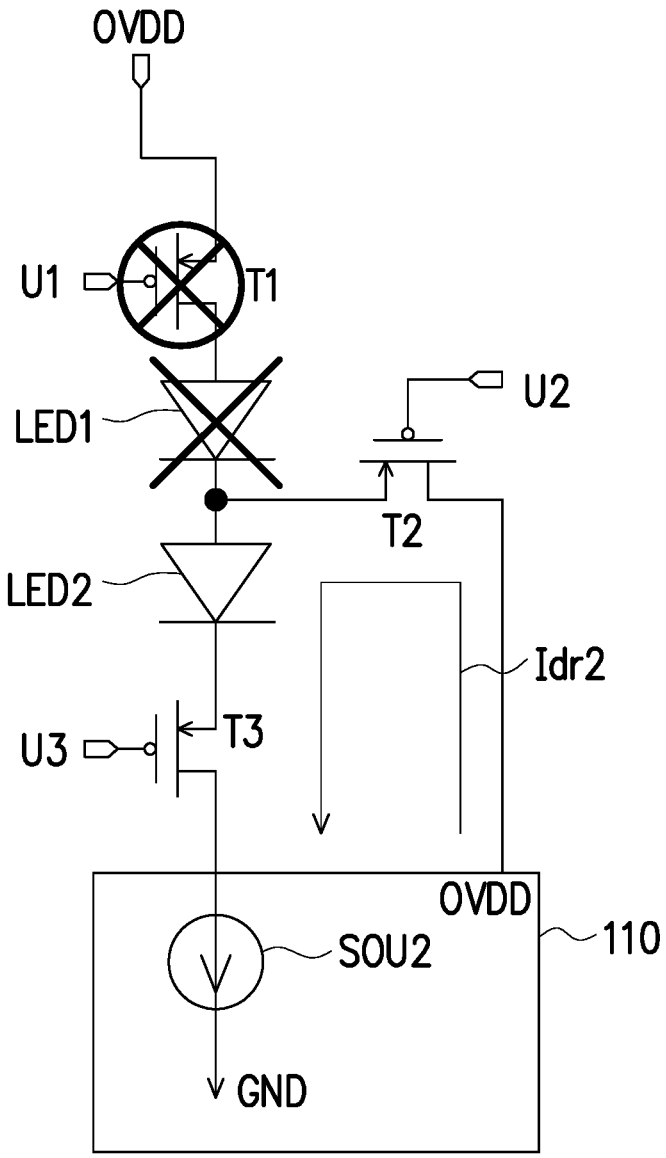

In another aspect, with reference to FIG. 1 and FIG. 2B, FIG. 2B illustrates the circuit operation of the display device depicted in FIG. 1 while the LED1 is in the damaged state. When the controller 110 determines that the LED1 is in the damaged state, and the LED2 is in the normal state, the transistor T1 is switched off according to the control signal U1 at the disabling voltage level, the transistor T3 is switched on according to the control signal U3 at the enabling voltage level, and the transistor T2 is switched on according to the control signal U2 at the enabling voltage level. Meanwhile, the controller 110 provides the electrical signal ECP3 to the first terminal of the transistor T3 and provides the electrical signal ECP2 to the first terminal of the transistor T2, so as to generate a driving current Idr2 to drive the LED2. At this time, the electrical signal ECP2 is the system voltage OVDD, and the electrical signal ECP3 is a drain current SOU2. One terminal of the drain current SOU2 is coupled to the first terminal of the transistor T3, while the other terminal is coupled to the reference ground voltage GND.

That is, the controller 110 at this time generates the driving current Idr2 by providing the system voltage OVDD and the drain current SOU2, so that the driving current Idr2 switches on the LED2, and the transistor T2, the LED2, the transistor T3, and the controller 110 can constitute a loop, which allows the LED2 to perform the compensation operation on the dark spots on pixels. Note that the driving current Idr2 is greater than the driving current Idr1 (i.e., the driving current while both the LED1 and the LED2 are undamaged), and thus the brightness of the LED2 herein is N times the original brightness of the LED2, wherein N is a real number.

That is, in the present embodiment, when the controller 110 determines that the LED1 is in the damaged state, the LED2 is driven by a relatively large driving current Idr2, so that the brightness of the LED2 is greater than the brightness when the LED1 and the LED2 are not damaged. For instance, when both the LED1 and the LED2 are not damaged, the driving current Idr1 can be applied to drive the LED1 and the LED2, so as to ensure the LED1 to have a first brightness (e.g., 50% of the brightness of one single pixel) and ensure the LED2 to have a second brightness (e.g., 50% of the brightness of one single pixel). As such, the brightness of the pixels of the LED1 and the LED2 is 100% of the brightness of one single pixel. When the controller 110 determines that the LED1 is in the damaged state, the LED2 is driven by a relatively large driving current Idr2, so that the LED2 has a relatively large brightness (e.g., 100% of the brightness of one single pixel). Thereby, if the LED1 is damaged (i.e., the LED1 is a dark spot on pixels), the LED2 having the relatively large brightness can compensate for the brightness of the dark spot on the pixels according to one or more embodiments of the disclosure, so as to maintain the brightness of the display device 100 (i.e., 100% of the brightness of one single pixel) and achieve automatic inspection of the dark spots on pixels as well as perform the compensation operation for brightness. As such, the display image can have the uniform brightness.

Figure 2C:
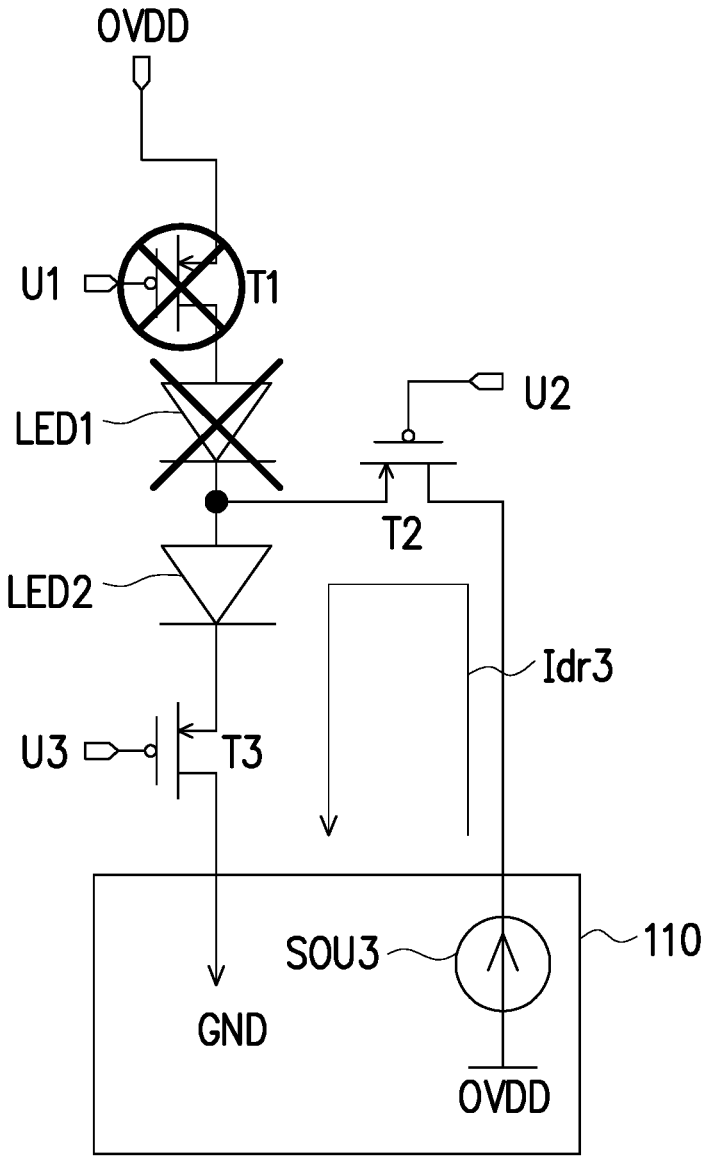

When the controller 110 determines that the LED1 is in the damaged state, it should be mentioned that a source current may also be applied to drive the LED2 as a pixel compensation. Please refer to FIG. 1 and FIG. 2C. FIG. 2C illustrates the circuit operation of the display device depicted in FIG. 1 while the LED1 is in the damaged state according to another embodiment of the disclosure. When the controller 110 determines that the LED1 is in the damaged state, and the LED2 is in the normal state, the transistor T1 is switched off according to the control signal U1 at the disabling voltage level, the transistor T3 is switched on according to the control signal U3 at the enabling voltage level, and the transistor T2 is switched on according to the control signal U2 at the enabling voltage level. Meanwhile, the controller 110 provides the electrical signal ECP3 to the first terminal of the transistor T3 and provides the electrical signal ECP2 to the first terminal of the transistor T2, so as to generate a driving current Idr3 to drive the LED2. Note that the electrical signal ECP3 is the reference ground voltage GND, and the electrical signal ECP2 is a source current SOU3. One terminal of the source current SOU3 is coupled to the first terminal of the transistor T2, while the other terminal is coupled to the system voltage OVDD.

That is, the controller 110 at this time generates the driving current Idr3 by providing the system voltage OVDD and the source current SOU3, so that the driving current Idr3 switches on the LED2, and the transistor T2, the LED2, the transistor T3, and the controller 110 can constitute a loop. Note that the driving current Idr3 is also greater than the driving current Idr1, and thus the brightness of the LED2 is N times the original brightness of the LED2 for compensating for the brightness of the dark spots on pixels.

Figure 2D:
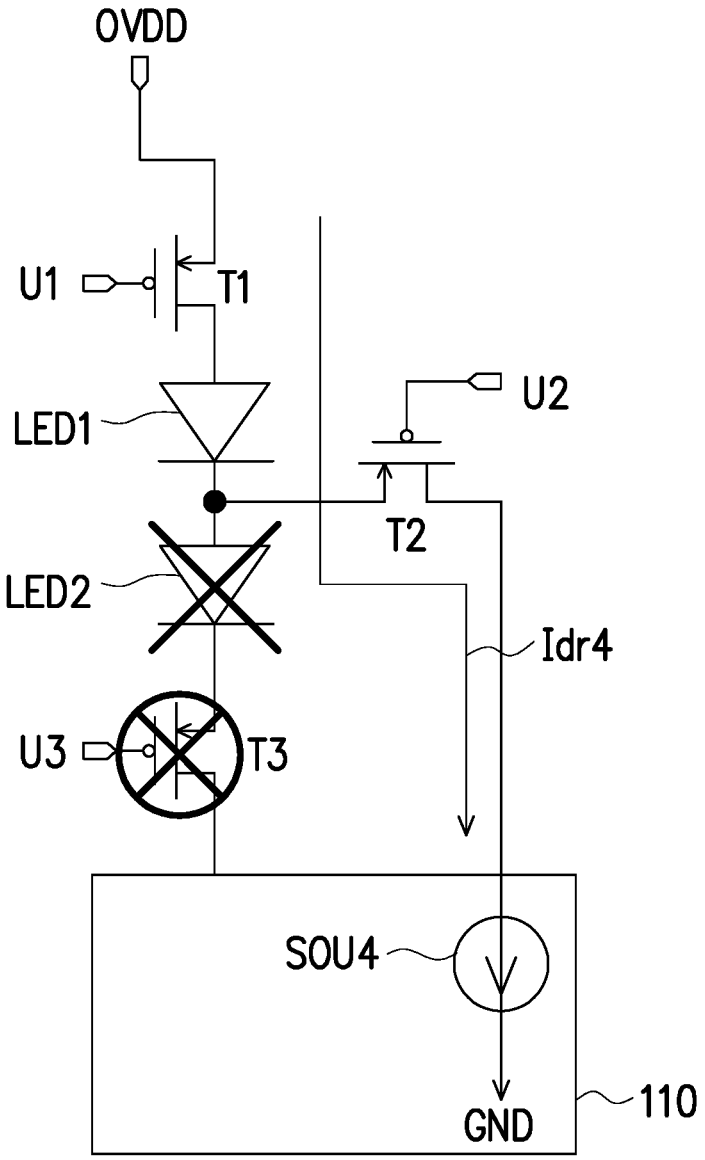

Please refer to FIG. 1 and FIG. 2D. FIG. 2D illustrates the circuit operation of the display device depicted in FIG. 1 while the LED2 is in the damaged state. When the controller 110 determines that the LED2 is in the damaged state, and the LED1 is in the normal state, the transistor T3 is switched off according to the control signal U3 at the disabling voltage level, the transistor T1 is switched on according to the control signal U1 at the enabling voltage level, and the transistor T2 is switched on according to the control signal U2 at the enabling voltage level. Meanwhile, the controller 110 provides the electrical signal ECP2 to the first terminal of the transistor T2, so as to generate a driving current Idr4 to drive the LED1. Note that the electrical signal ECP2 is a drain current SOU4. One terminal of the drain current SOU4 is coupled to the first terminal of the transistor T2, while the other terminal is coupled to the reference ground voltage GND.

That is, the controller 110 at this time generates the driving current Idr4 with the electrical signal ECP2 (i.e., the system voltage OVDD) by providing the drain current SOU4, the driving current Idr4 switches on the LED1, and the transistor T1, the LED1, the transistor T2, and the controller 110 can constitute an electric current path, which allows the LED2 to perform the compensation operation on the dark spots on pixels. Note that the driving current Idr4 is also greater than the driving current Idr1, and thus the brightness of the LED1 is N times the original brightness of the LED1, wherein N is a real number.

Figure 3A:
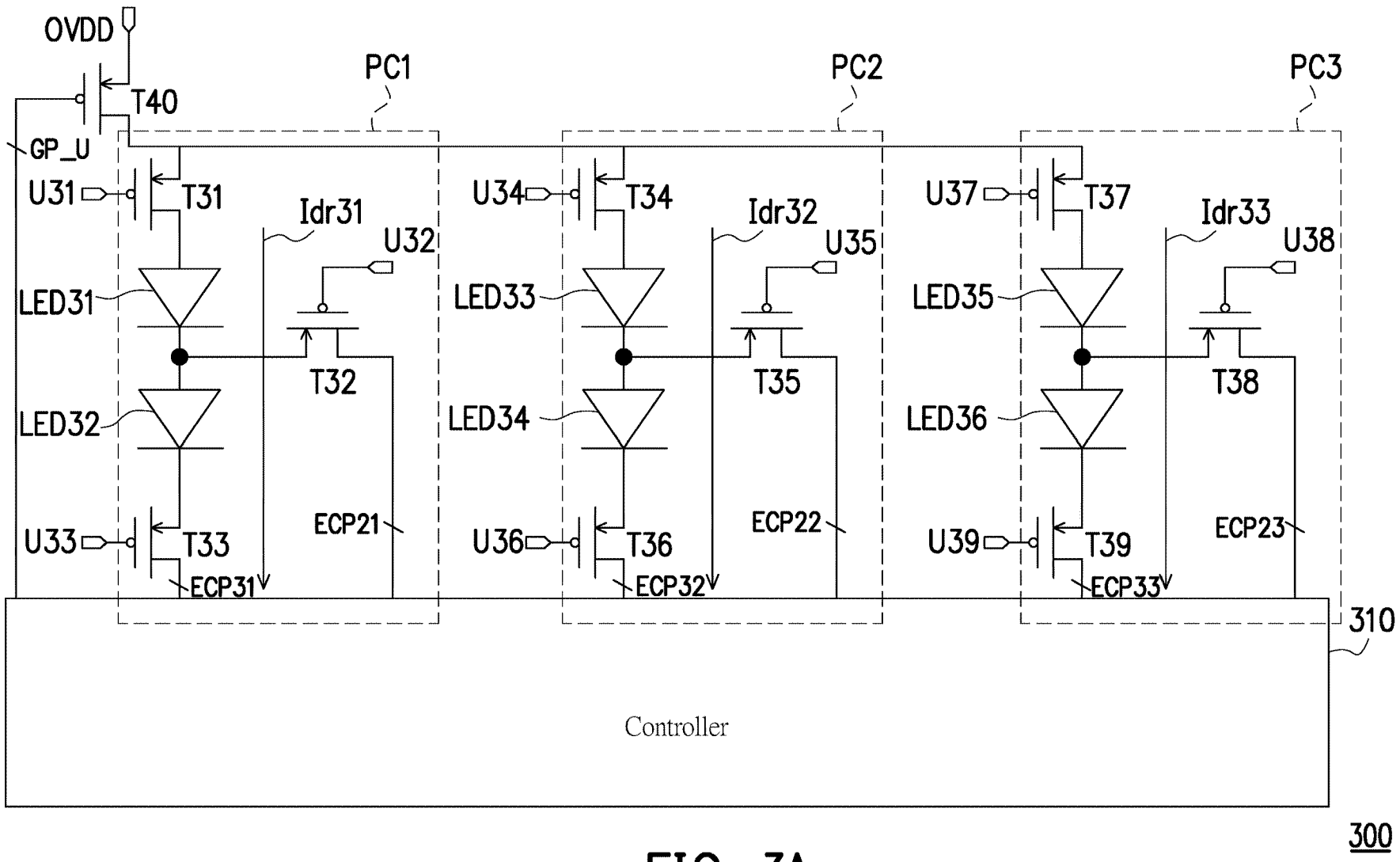
FIG. 3A is a schematic block view illustrating a circuit of a display device according to another embodiment of the disclosure.

Please refer to FIG. 3A. FIG. 3A is a schematic block view illustrating a circuit of a display device according to another embodiment of the disclosure. The display device 300 provided in the present embodiment includes LEDs LED31-LED36, transistors T31-T40, and a controller 310, and the difference between the present embodiment and the previous embodiment depicted in FIG. 1 lies in that the display device 300 can perform automatic inspection and the compensation operation on the dark sports on pixels on multiple sets of pixel circuits (e.g., pixel circuits PC1, PC2, and PC3). That is, the controller 310 provided in the present embodiment can be coupled to multiple sets of pixel circuits (i.e., the pixel circuits PC1, PC2, and PC3) constituted by LEDs and switches. In order to simplify the description, note that only three sets of pixel circuits PC1-PC3 are illustrated as an exemplary embodiment in the drawings, whereas the number of the pixel circuits is not limited in the disclosure.

Specifically, a first terminal of the transistor T31 receives the system voltage OVDD (e.g., the electrical signal ECP1 provided in the embodiment shown in FIG. 1) through the transistor T40, and a second terminal of the transistor T31 is coupled to an anode of the LED31. A first terminal of the transistor T32 receives an electrical signal ECP21, and a second terminal of the transistor T32 is coupled to a cathode of the LED31. An anode of the LED32 is coupled to the cathode of the LED31. A first terminal of the transistor T33 receives an electrical signal ECP31, and a second terminal of the transistor T33 is coupled to a cathode of the LED32, wherein whether the transistors T31-T33 are switched on or off is determined by whether the LED31 and the LED32 are damaged or not.

A first terminal of the transistor T34 receives the system voltage OVDD through the transistor T40, and a second terminal of the transistor T34 is coupled to an anode of the LED33. A first terminal of the transistor T35 receives an electrical signal ECP22, and a second terminal of the transistor T35 is coupled to a cathode of the LED33. An anode of the LED34 is coupled to the cathode of the LED33. A first terminal of the transistor T36 receives an electrical signal ECP32, and a second terminal of the transistor T36 is coupled to a cathode of the LED34, wherein whether the transistors T34-T36 are switched on or off is determined by whether the LED33 and the LED34 are damaged or not. A first terminal of the transistor T37 receives the system voltage OVDD through the transistor T40, and a second terminal of the transistor T37 is coupled to an anode of the LED35. A first terminal of the transistor T38 receives an electrical signal ECP23, and a second terminal of the transistor T38 is coupled to a cathode of the LED35. An anode of the LED36 is coupled to the cathode of the LED35. A first terminal of the transistor T39 receives an electrical signal ECP33, and a second terminal of the transistor T39 is coupled to a cathode of the LED36, wherein whether the transistors T37-T39 are switched on or off is determined by whether the LED35 and the LED36 are damaged or not. A first terminal of the transistor T40 receives the system voltage OVDD, a second terminal of the transistor T40 is coupled to the transistors T31, T34, and T37, and a control terminal of the transistor T40 receives a control signal GP_U provided by the controller 310, wherein the transistor T40 is switched on according to the control signal GP_U, so as to transmit the system voltage OVDD. By the way, the control signals U31-U39 and the control signal GP_U can be pulse width modulation (PWM) signals, for instance, which should however not be construed as a limitation in the disclosure.

Figure 3B:
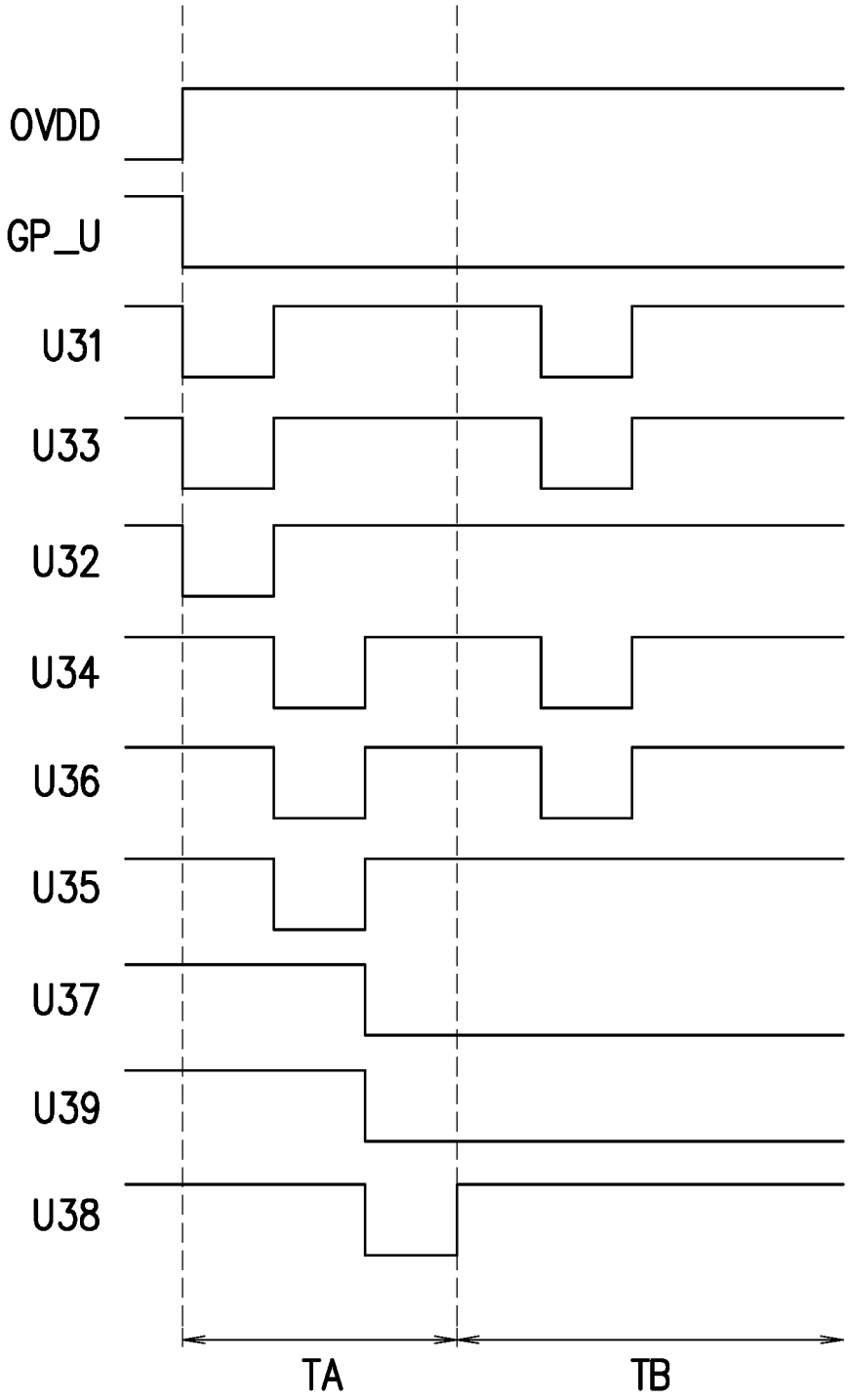
FIG. 3B is a schematic view illustrating a control signal waveform of the display device depicted in FIG. 3A.

Next, please refer to FIG. 3A and FIG. 3B. FIG. 3B is a schematic view illustrating a control signal waveform of the display device depicted in FIG. 3A. In the present embodiment, the controller 310 also automatically detects the LEDs (i.e., the LED31-the LED36) in multiple sets of pixel circuits, so as to determine whether the LEDs are damaged. Particularly, in an inspection time period TA, the system voltage OVDD is at a high voltage level, and the control signal GP_U is at an enabling voltage level, so as to switch on the transistor T40 to transmit the system voltage OVDD. First, the controller 310 detects the LED31 and the LED32 in the pixel circuit PC1, and the controller 310 respectively provides the control signals U31-U33 at the enabling voltage level to the transistors T31-T33, so as to switch on the transistors T31-T33 to determine whether the LED31 and the LED32 are damaged or not according to a voltage on the cathode of the LED31.

After the inspection on the LED31 and the LED32 is completed, the controller 310 detects the LED33 and the LED34 in the pixel circuit PC2, and the controller 310 respectively provides the control signals U34-U36 at the enabling voltage level to the transistors T34-T36, so as to switch on the transistors T34-T36 to determine whether the LED33 and the LED34 are damaged or not according to a voltage on the cathode of the LED33. After the inspection on the LED33 and the LED34 is completed, the controller 310 then detects the LED35 and the LED36 in the pixel circuit PC3 and respectively provides the control signals U37-U39 at the enabling voltage level to the transistors T37-T39, so as to switch on the transistors T37-T39 to determine whether the LED35 and the LED36 are damaged or not according to a voltage on the cathode of the LED35.

To simplify the description, according to the present embodiment, the LED31 and the LED32 in the pixel circuit PC1, the LED33 and the LED34 in the pixel circuit PC2, and the LED35 and the LED36 in the pixel circuit PC3 are sequentially inspected in the inspection time period TA; however, the order of inspecting the LEDs in each pixel circuit is not limited herein. That is, the LED33 and the LED34 in the pixel circuit PC2 or the LED35 and the LED36 in the pixel circuit PC3 can also be inspected at first. In other embodiments of the disclosure, the LEDs of the pixel circuits PC1-PC3 can be simultaneously inspected, and thus people having ordinary skill in the art can made proper adjustments to the order of inspecting the LEDs in each pixel circuit according to actual application scenarios, and the illustration in FIG. 3B does not serve to pose any limitation in the disclosure.

When the controller 310 determines that the LEDs in each of the pixel circuits PC1-PC3 are not damaged, next, in a display time period TB, the controller 310 respectively provides the control signals U31, U33, U34, U36, U37, and U39 at the enabling voltage level to the corresponding transistors, so as to switch on the transistors T31, T33, T34, T36, T37, and T39 and further generate a driving current Idr31 to drive the LED31 and the LED32, generate a driving current Idr32 to drive the LED33 and the LED34, and generate a driving current Idr33 to drive the LED35 and the LED36. As such, the display device 300 is allowed to perform the normal display operation.

In the present embodiment, note that light emitting wavelengths of the LED31 and the LED32 are equal, and the LED31 and the LED32 can be red LEDs, for instance. Light emitting wavelengths of the LED33 and the LED34 are equal, and the LED33 and the LED34 can be green LEDs, for instance. Light emitting wavelengths of the LED354 and the LED36 are equal, and the LED35 and the LED36 can be blue LEDs, for instance. In other words, the light emitting wavelengths of the LED31 and the LED32 can be different from the light emitting wavelengths of the LED33 and the LED34, and the light emitting wavelengths of the LED31 and the LED32 can also be different from the light emitting wavelengths of the LED35 and the LED36. In other embodiments of the disclosure, note that the light emitting wavelengths of the LED31 and the LED32 can also be equal to those of the LED33 to the LED36, which should not be construed as a limitation in the disclosure, and thus people having ordinary skill in the art can made proper adjustments to the light emitting wavelengths of the LED31 to the LED36 according to actual application scenarios.

Figure 3C:
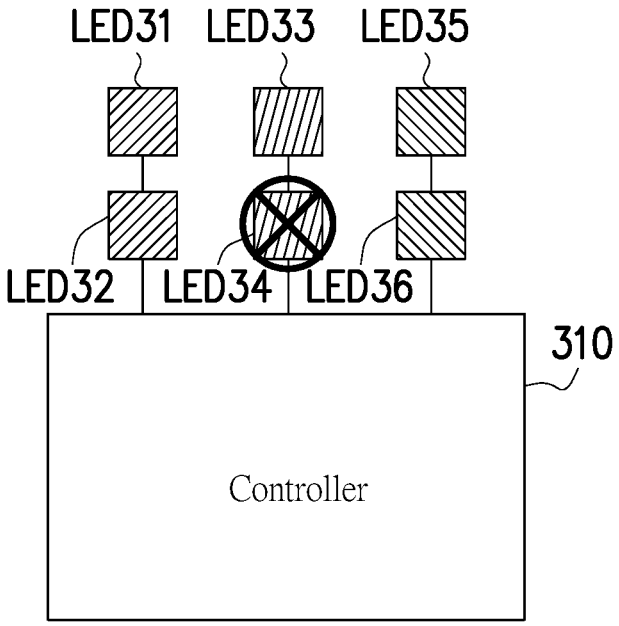
FIG. 3C is schematically illustrates a compensation manner of the LEDs depicted in FIG. 3A.

As such, when the controller 310 detects that there is any damage to the LEDs in the pixel circuits PC1-PC3, each pixel circuit can perform mutual compensation operations with use of the LEDs having the same light emitting wavelength. To be specific, please refer to FIG. 3A and FIG. 3C. FIG. 3C schematically illustrates a compensation manner of the LEDs depicted in FIG. 3A. According to the present embodiment, the light emitting wavelength of the LED31 is equal to that of the LED32, and the light emitting wavelength of the LED35 is equal to that of the LED36. Hence, when one of the two LEDs in each of the pixel circuits PC1-PC3 is damaged, e.g., when the LED34 in the pixel circuit PC2 is in the damaged state (i.e., the LED34 is the dark spot on pixels at this time), a relatively large driving current can be applied to drive the other one of the two LEDs (i.e., the LED33) in the pixel circuit PC2, so as to ensure the greater brightness of the LED33 having the same light emitting wavelength, whereby the compensation operation can be performed on the dark spots on pixels.

Besides, in other embodiments of the disclosure, when the light emitting wavelengths of the LEDs in all pixel circuits are equal (e.g., the LEDs of all pixel circuits are the red LEDs, the green LEDs, or the blue LEDs), and if one of the two LEDs in one pixel circuit is damaged, the controller 310 drives the LEDs in the adjacent pixel circuit by a relatively large driving current, so as to increase the brightness of the LEDs in the adjacent pixel circuit for compensation. For instance, when at least one of the LED33 and the LED34 in the pixel circuit PC2 is in the damaged state, the controller 310 drives the LEDs (i.e., the LED31 and the LED32 in the pixel circuit PC1 or the LED35 and the LED36 in the pixel circuit PC3) in the adjacent pixel circuit by a relatively large driving current, so as to compensate for the dark spots on pixels due to damages to the at least one of the LEDs. As such, the effects of automatic inspection and compensation for the brightness of the dark spots on the pixels can be achieved, and the brightness of the display image is uniform.

Figure 3D:
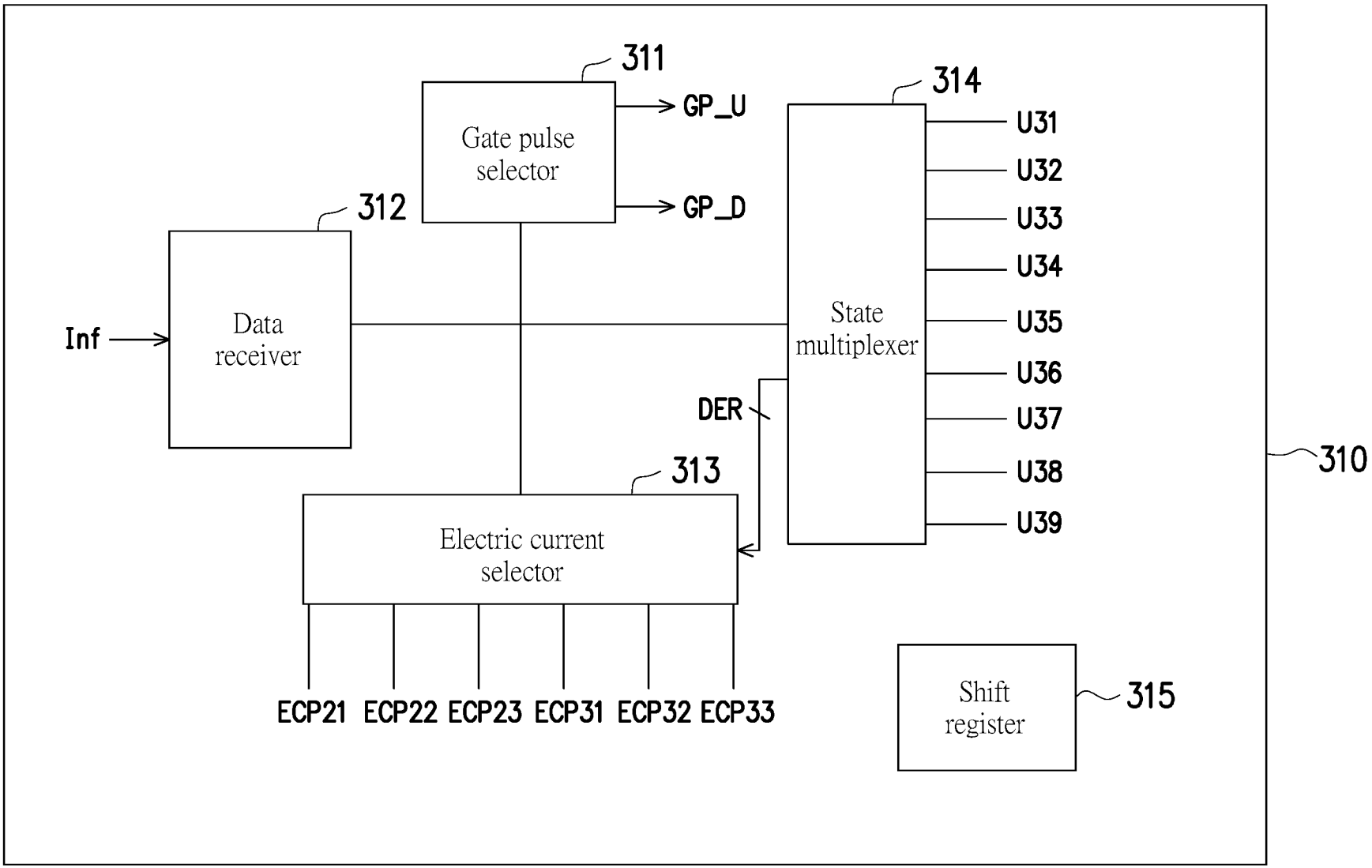
FIG. 3D is a schematic block view illustrating a circuit of the controller depicted in FIG. 3A.

In another aspect, please refer to FIG. 3A and FIG. 3D. FIG. 3D is a schematic block view illustrating a circuit of the controller depicted in FIG. 3A. According to the present embodiment, the controller 310 includes a gate pulse selector 311, a data receiver 312, an electric current selector 313, a state multiplexer 314, and a shift register 315. The data receiver 312 is configured to receive an image data signal Inf. The gate pulse selector 311 is coupled to the data receiver 312 and configured to provide the gate control signal GP_U to the transistor T40 according to the image data signal Inf, so as to control whether or not the transistor T40 transmits the system voltage OVDD to the pixel circuits PC1-PC3. In FIG. 3A, note that plural pixel circuits can be further disposed below the display device 300, the transistor controlling whether to transmit system voltage OVDD to the pixel circuits is also included, and whether the transistor is switched on or off is controlled by the gate control signal GP_D. That is, the gate pulse selector 311 provided in the present embodiment can also provide the gate control signal GP_D to the control terminal of the transistor below the display device 300, so as to control whether or not the transistor transmits the system voltage OVDD to the pixel circuits below the display device 300. Note that the structures and the operations of the pixel circuits below the display device 300 are similar to those of the pixel circuits PC1-PC3, and therefore no further explanation is provided hereinafter. The gate control signal GP_D can also be the PWM signal, for instance, which should however not be construed as a limitation in the disclosure.

The state multiplexer 314 is coupled to the data receiver 312. When the display device 300 enters the inspection time period TA, the state multiplexer 314 detects a voltage on the cathode of the first LED (e.g., the LED31, the LED33, the LED35) in each pixel circuit, so as to determine the damaged state of each of the LED31 to LED36, adjust the control signals U31-U39 to be at the enabling voltage level or the disabling voltage level corresponding to the damaged state of each of the LED31 to LED36, and simultaneously generate an inspection result signal DER and provide to the electric current selector 313. The electric current selector 313 is coupled to the data receiver 312 and selects a drain current, a source current, or a reference ground voltage as the electrical signals ECP21-ECP33 according to the inspection result signal DER provided by the state multiplexer 314.

For instance, when the state multiplexer 314 determines that the LED31 and the LED32 are both in the normal state according to the voltage on the cathode of the LED31 in the pixel circuit PC1, the electric current selector 313 provides a drain current SOU1 as the electrical signal ECP31 according to the inspection result DER. For instance, when the state multiplexer 314 determines that the LED32 is in the damaged state, and that the LED31 is in the normal state according to the voltage on the cathode of the LED31 in the pixel circuit PC1, the electric current selector 313 provides a drain current SOU4 as the electrical signal ECP21 according to the inspection result signal DER.

When the state multiplexer 314 determines that the LED31 is in the damaged state, and the LED32 is in the normal state according to the voltage on the cathode of the LED31 in the pixel circuit PC1, the electric current selector 313 provides the drain current SOU2 as the electrical signal ECP31 according to the inspection result signal DER and provides the system voltage OVDD as the electrical signal ECP21. When the state multiplexer 314 determines that the LED31 is in the damaged state and that the LED32 is in the normal state according to the voltage on the cathode of the LED31 in the pixel circuit PC1, note that the electric current selector 313 can also provide the source current SOU3 as the electrical signal ECP21 according to the inspection result signal DER and provide the reference ground voltage GND as the electrical signal ECP31. Note that whether the electric current selector 313 decides to provide the drain current or the source current can be set by the user or automatically set by the electric current selector 313, which should not be construed as a limitation in the disclosure. Besides, the shift register 315 included in the controller 310 provided in the present embodiment is configured to generate a plurality of gate driving signals for driving a plurality of thin film transistors. As such, in one or more embodiments of the disclosure, the shift register can be disposed in the controller, so that the display device provided herein can achieve favorable effects while it is applied to the spliced panels of the display device.

Note that how the controller 310 determines whether the LEDs in each pixel circuit are damaged or not as well as the circuit operations and the signal waveforms of each pixel while the LEDs therein perform the compensation operation on the dark spots on pixels are similar to those provided in the embodiment depicted in FIG. 1, and therefore no further explanation is provided hereinafter. In another aspect, the circuit structures and the implementation manner of the controller 110 provided in the embodiment depicted in FIG. 1, the controller 410 provided in the embodiment depicted in FIG. 4, the controllers 510-518 provided in the embodiment depicted in FIG. 5, and the controller 610 provided in the embodiment depicted in FIG. 6 are similar, and people having ordinary skill in the art are able to implement the controllers 110, 410, 511-518, and 610 provided in the present embodiment according to the descriptions provided in the previous embodiment depicted in FIG. 3A, and therefore no further explanation is provided hereinafter.

Figure 4:
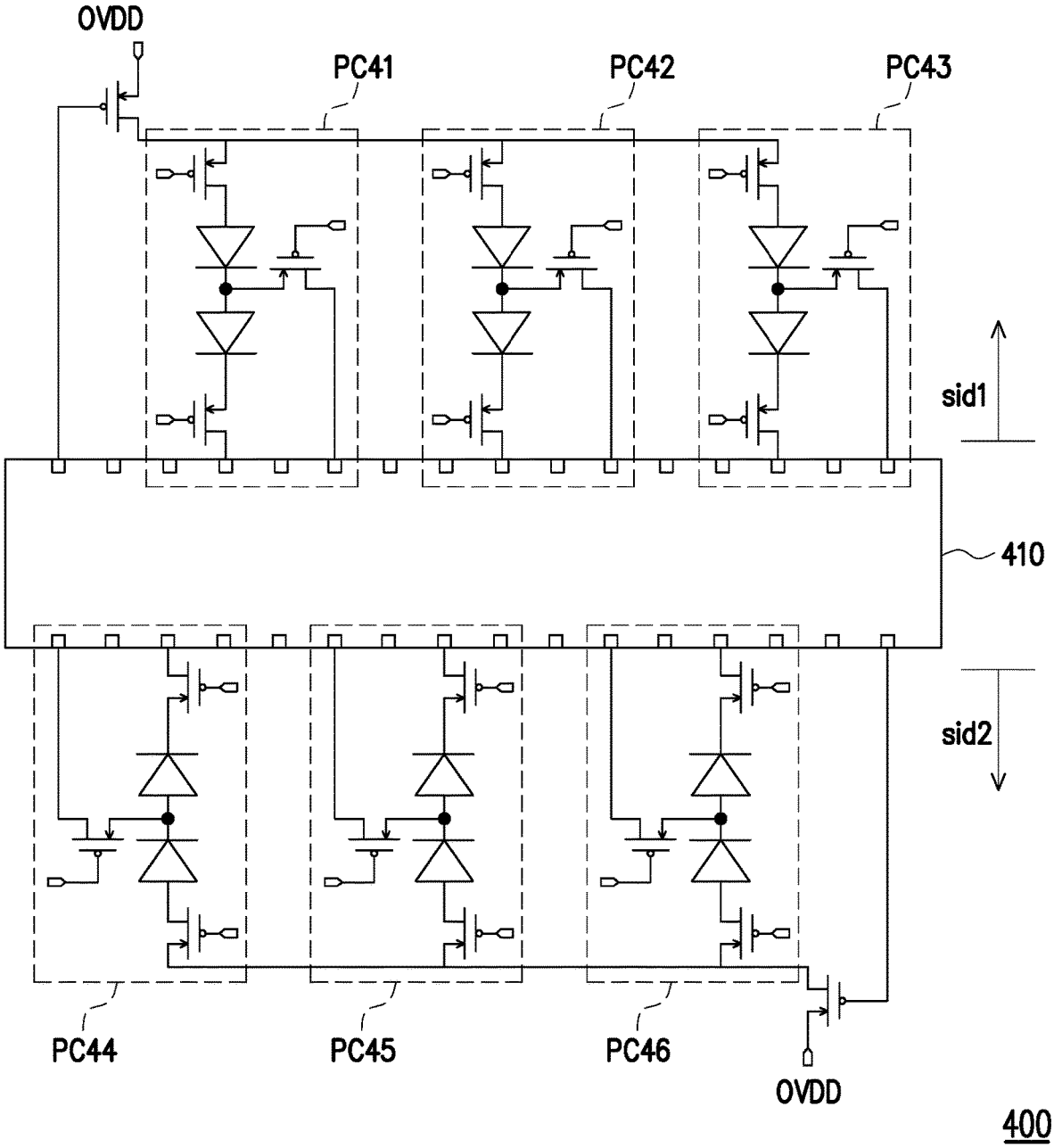
FIG. 4 is a schematic block view illustrating a circuit of a display device according to another embodiment of the disclosure.

With reference to FIG. 4, FIG. 4 is a schematic block view illustrating a circuit of a display device according to another embodiment of the disclosure. The difference between the present embodiment and the previous embodiment depicted in FIG. 3A lies in that the controller 410 of the display device 400 provided in the present embodiment not only includes the pixel circuits PC41-PC43, but also includes pixel circuits PC44-PC46, and the pixel circuits PC41-PC43 and the pixel circuits PC44-PC46 are coupled to opposite sides of the controller 410. That is, the controller 410 has a first side Sid1 and a second side Sid2, the pixel circuits PC41-PC43 are located on the first side Sid1 of the controller 410, and the pixel circuits PC44-PC46 are located on the second side Sid2 of the controller 410. Namely, plural pixel circuits can be coupled to different sides of the controller 410 provided in the present embodiment, wherein the structure of each pixel circuit is similar to those provided in the embodiments depicted in FIG. 1 and FIG. 3A, and people having ordinary skill in the art can implement the display device 400 provided in the present embodiment according to the descriptions provided in the previous embodiments; therefore, no further explanation is provided hereinafter. Note that how the controller 410 determines whether the LEDs in each pixel circuit are damaged or not as well as the circuit operations and the signal waveforms of each pixel while the LEDs therein perform the compensation operation on the dark spots on pixels are similar to those provided in the embodiments depicted in FIG. 1 and FIG. 3A, and therefore no further explanation is provided hereinafter.

According to the previous descriptions, it can be easily learn that in the display device 400 provided in the present embodiment, when controller 410 detects that there is any damage to the LEDs in the pixel circuits PC41-PC46, each pixel circuit can perform mutual compensation operations with use of the LEDs having the same light emitting wavelength. For instance, when at least one of the two LEDs in the pixel circuit PC42 is damaged, the controller 410 can drive the LEDs in the adjacent pixel circuits (i.e., the pixel circuits PC41 and PC43) by a relatively large driving current, so as to compensate for the dark spots on pixels due to damages to the LEDs in the pixel circuit PC42. Besides, when at least one of the two LEDs in the pixel circuit PC42 is damaged, the controller 410 provided in the present embodiment can also drive the LEDs in the pixel circuits (i.e., the pixel circuits PC44-PC46) on the opposite side by a relatively large driving current, so as to compensate for the dark spots on pixels due to damages to the LEDs in the pixel circuit PC42. In other words, the display device 400 provided in the present embodiment not only can compensate for the dark spots on pixels in the adjacent pixel circuits but also allows mutual compensation between the pixel circuits PC41-PC43 on the first side Sid1 and the pixel circuits PC44-PC46 on the second side Sid2.

In order to simplify the description, note that only three pixel circuits are illustrated on the first side Sid1 and the second side Sid2 of the controller 410 as an exemplary embodiment in the drawings, whereas the number of the pixel circuits coupled to different sides of the controller 410 is not limited in the disclosure, i.e., the illustration in FIG. 4 does not serve to pose any limitation in the disclosure.

Figure 5:
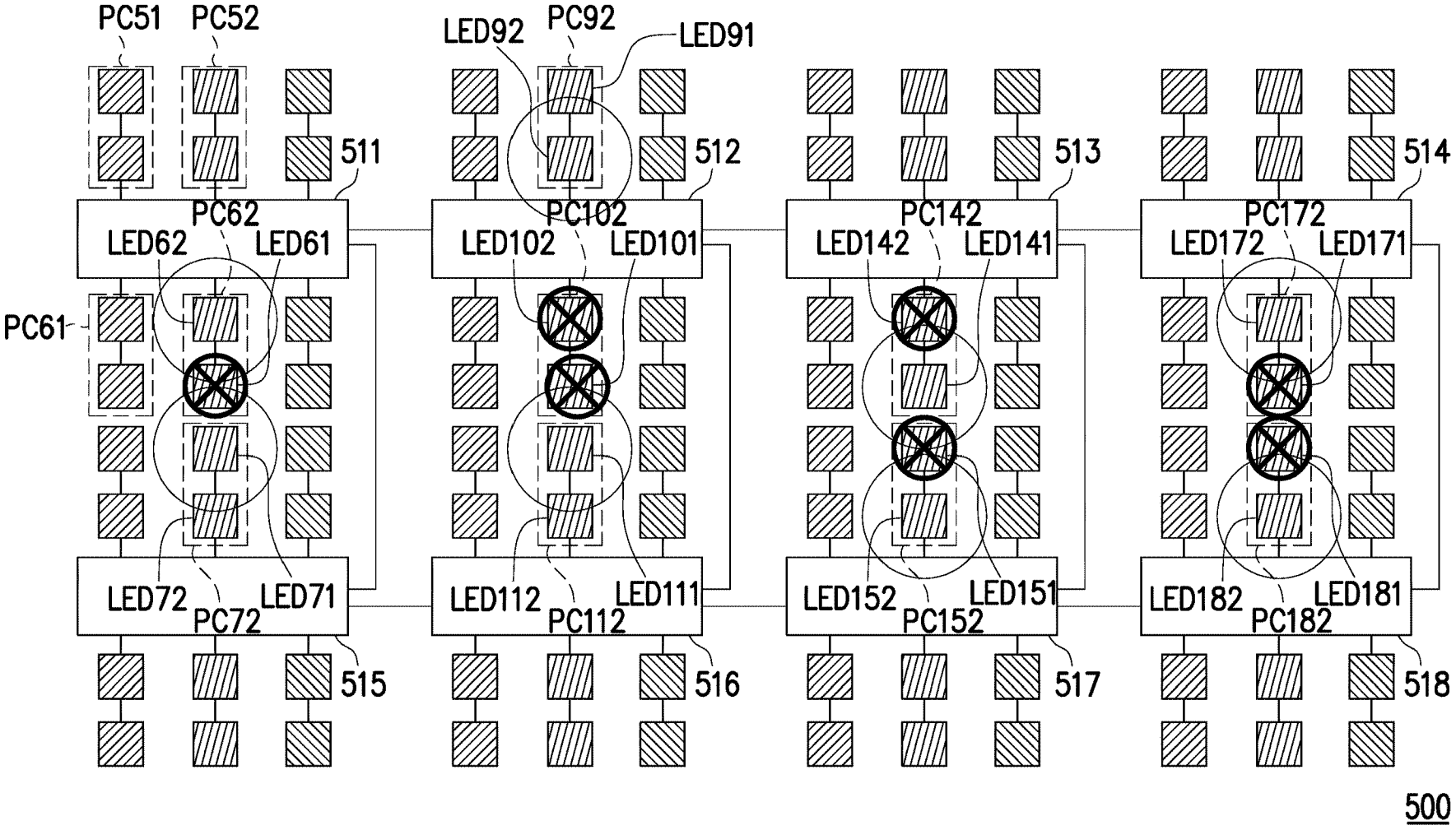
FIG. 5 schematically illustrates a compensation manner of LEDs according to another embodiment of the disclosure.

With reference to FIG. 5, FIG. 5 schematically illustrates a compensation manner of LEDs according to another embodiment of the disclosure. The display device 500 provided in the present embodiment includes a plurality of controllers 511-518 coupled to each other, and plural pixel circuits (e.g., pixel circuits PC51, PC52, PC61, and PC62) are coupled to both sides of each of the controllers 511-518, so that the structure of each of the controllers 511-518 and the pixel circuits thereof is similar to that in the display device 400 provided in the embodiment depicted in FIG. 4. The difference between the previous embodiment and the present embodiment lies in that in the display device 500 provided in the present embodiment, when the controller 511 detects that there is any damage to the LEDs in the pixel circuits, each pixel circuit can perform the compensation operations on the dark spots on pixels with use of the LEDs in the pixel circuits corresponding to the adjacent controllers. For instance, when the controller 511 determines that at least one of the two LEDs (e.g., the LED61 in the pixel circuit PC62) in the corresponding pixel circuit is in the damaged state, the controller 511 transmits a compensation signal to the controller 515, and the controller 515 provides a plurality of control signals to the switches in the pixel circuit PC72 according to the compensation signal, so as to generate a driving current to drive the LED71 and the LED72. As such, the LED62 of the pixel circuit PC62 and the LED72 of the pixel circuit PC72 can simultaneously compensate for the brightness of the dark spots on pixels due to the damages to the LED61.

In another aspect, when the controller 512 determines that the two LEDs (e.g., the LED101 and the LED102 in the pixel circuit PC102) in the corresponding pixel circuit are both in the damaged state, the controller 512 generates a relatively large driving current to drive the LED91 and the LED92 and transmits the compensation signal to the controller 516, and the controller 516 provides the control signals to the switches in the pixel circuit PC112 according to the compensation signal, so as to generate a relatively large driving current to drive the LED111 and the LED112. As such, the LED92 of the pixel circuit PC92 and the LED111 of the pixel circuit PC112 can simultaneously compensate for the brightness of the dark spots on pixels due to the damages to the LED101 and the LED102.

Additionally, when the controller 513 determines that one of the two LEDs (e.g., the LED142 in the pixel circuit PC142) in the corresponding pixel circuit is in the damaged state, and the adjacent controller 517 determines that one of the two LEDs (e.g., the LED151 in the pixel circuit PC152) in the corresponding pixel circuit is in the damaged state, the controller 513 generates a relatively large driving current to drive the LED141 and transmits the compensation signal to the controller 517, and the controller 517 generates a relatively large driving current to drive the LED152 according to the compensation signal and the damaged state of the LED151, so that the LED141 of the pixel circuit PC142 and the LED152 of the pixel circuit PC152 can simultaneously compensate for the brightness of the dark spots on pixels due to the damages to the LED142 and the LED151.

In another aspect, when the controller 514 determines that one of the two LEDs (e.g., the LED171 in the pixel circuit PC172) in the corresponding pixel circuit is in the damaged state, and the adjacent controller 518 determines that one of the two LEDs (e.g., the LED181 in the pixel circuit PC182) in the corresponding pixel circuit is in the damaged state, the controller 514 generates a relatively large driving current to drive the LED172 and transmits the compensation signal to the controller 518, and the controller 518 generates a relatively large driving current to drive the LED182 according to the compensation signal and the damaged state of the LED181, so that the LED171 of the pixel circuit PC172 and the LED182 of the pixel circuit PC182 can simultaneously compensate for the brightness of the dark spots on pixels due to the damages to the LED171 and the LED181.

According to the previous descriptions, it can be easily learn that in the display device 500 provided in the present embodiment, when the controllers 511-518 detect that there is any damage to the LEDs in the corresponding pixel circuits, each of the controllers 511-518 can perform the mutual compensation operation on the LEDs in the pixel circuits with use of the LEDs having the same light emitting wavelength. Note that the structure of each pixel circuit provided in the present embodiment is similar to those provided in the embodiments depicted in FIG. 1, FIG. 3A, and FIG. 4, and people having ordinary skill in the art can implement the display device 500 provided in the present embodiment according to the descriptions provided in the previous embodiments; therefore, no further explanation is provided hereinafter. Besides, how the controllers 511-518 determine whether the LEDs in each pixel circuit are damaged or not as well as the circuit operations and the signal waveforms of each pixel while the LEDs therein perform the compensation operation on the dark spots on pixels are similar to those provided in the embodiments depicted in FIG. 1, FIG. 3A, and FIG. 4, and therefore no further explanation is provided hereinafter.

Figure 6A:
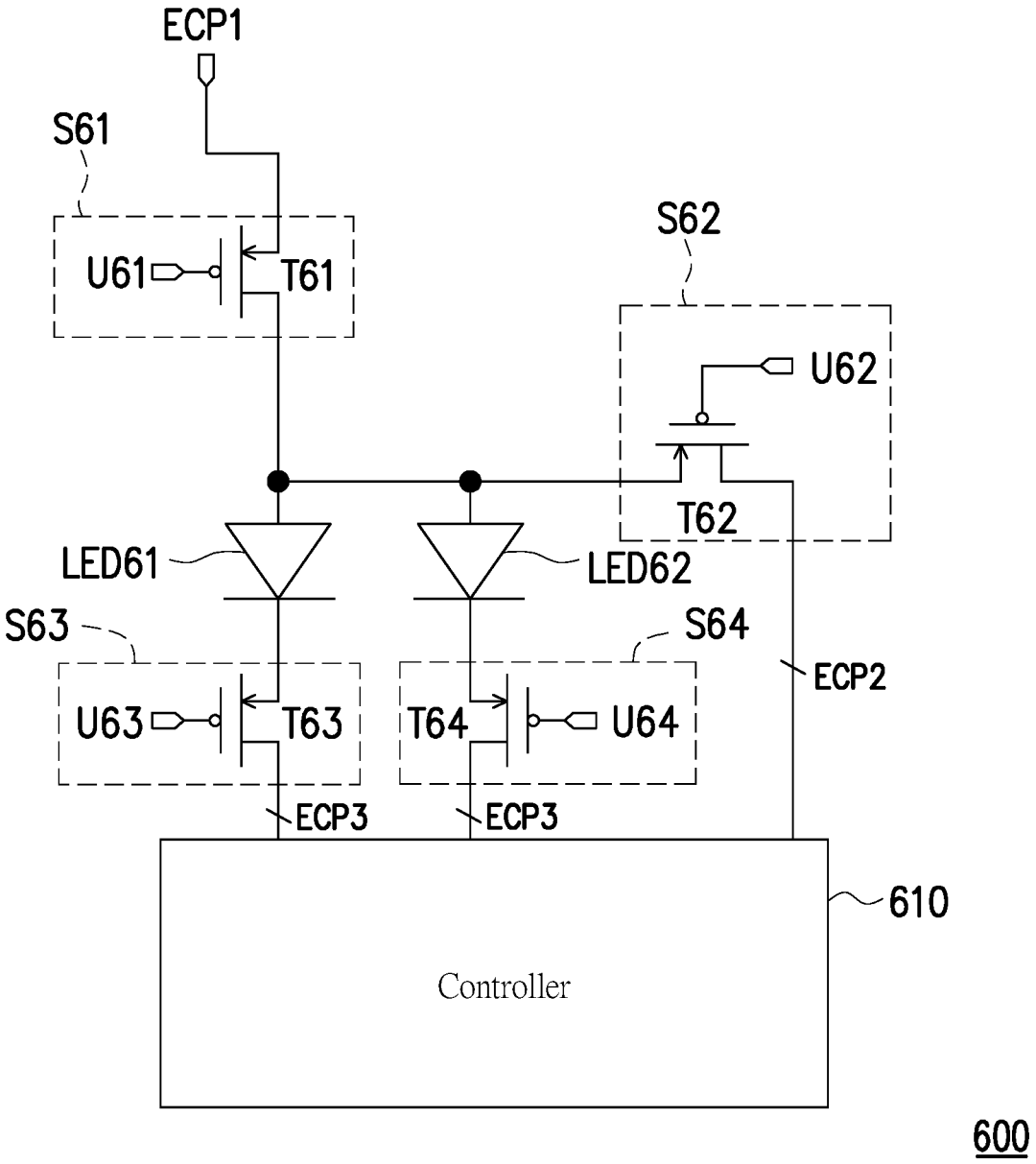
FIG. 6A is a schematic block view of illustrating a circuit of a display device according to another embodiment of the disclosure.

With reference to FIG. 6A, FIG. 6A is a schematic block view illustrating a circuit of a display device according to another embodiment of the disclosure. The display device 600 includes an LED61, an LED62, switches S61-S64, and a controller 610. Note that the switches S61-S63 provided in the present embodiment can be implemented in form of p-type transistors as an exemplary embodiment, which should however not be construed as a limitation in the disclosure, and the switches can also be implemented in form of n-type transistors (i.e., transistors T61-T63). In the present embodiment, the electrical signal ECP1 can be, for instance, a system voltage OVDD, which should however not be construed as a limitation in the disclosure. A first terminal of the transistor T61 receives an electrical signal ECP1, and a second terminal of the transistor T61 is coupled to an anode of the LED61. A first terminal of the transistor T62 receives an electrical signal ECP2, and a second terminal of the transistor T62 is coupled to the anode of the LED61. An anode of the LED62 is coupled to the anode of the LED61. A first terminal of the transistor T63 receives an electrical signal ECP3, and a second terminal of the transistor T63 is coupled to a cathode of the LED61. A first terminal of the transistor T64 also receives the electrical signal ECP3, and a second terminal of the transistor T64 is coupled to a cathode of the LED62, wherein whether the switches S61-S64 (i.e., the transistors T61-T64) are switched on or off is determined by whether the LED61 and the LED62 are damaged or not.

In another aspect, the controller 610 is configured to detect whether the LED61 and the LED62 are damaged or not, generate the electrical signal ECP2 and the electrical signal ECP3, and generate a plurality of control signals (e.g., control signals U61-U64) controlling the transistors T61-T64. By the way, the control signals U61-U64 can be PWM signals, for instance, which should however not be construed as a limitation in the disclosure. Particularly, the controller 610 of the display device 600 provided in the present embodiment can provide the control signals U61-U64 at the enabling voltage level to switch on the transistors T61-T64, so as to detect the damaged states of the LED61 and the LED62 according to the voltages on the anodes of the LED61 and the LED62 and respectively provide the control signals U61-U64 to the transistors T61-T64 according to the damage states of the LED61 and LED62. As such, in response to the different damaged states of the LED61 and the LED62, the transistors T61-T64 are switched on or off, so as to perform the compensation operation on the dark spots on pixels. That is, the LED61, the LED62, and the transistors T61-T64 provided herein can be considered as one set of pixel circuit, and the controller 610 is applied to detect the pixel circuit, so as to determine whether there is any dark spot on the pixels due to damages to the LED61 and the LED62 and whether the compensation operation on the dark spots on pixels is required.

Figure 6B:
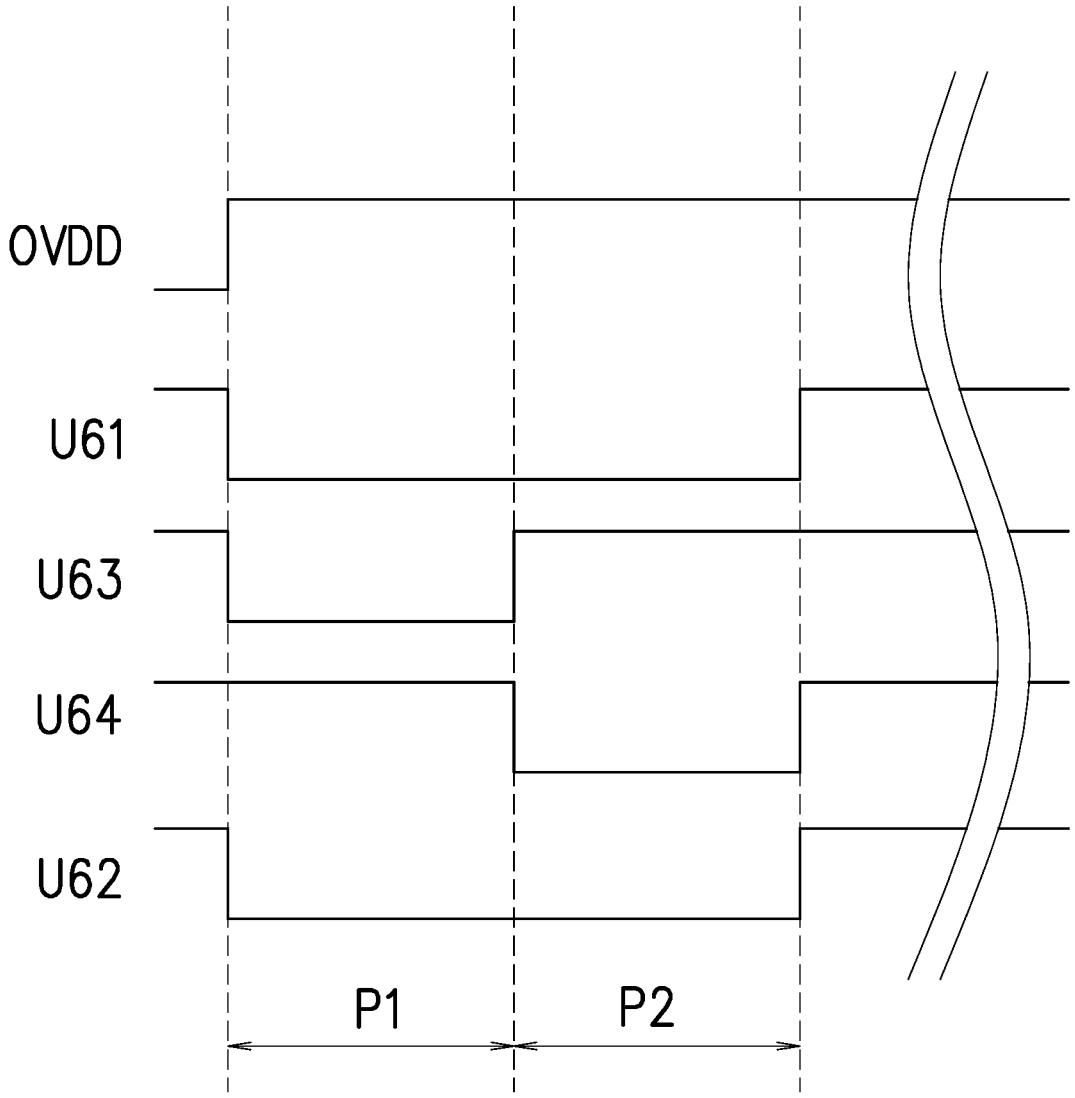
FIG. 6B is a schematic view illustrating a control signal waveform of the display device depicted in FIG. 6A.

More particularly, please refer to FIG. 6A and FIG. 6B. FIG. 6B is a schematic view illustrating a control signal waveform of the display device depicted in FIG. 6A. In the present embodiment, the controller 610 can automatically detect the LED61 and the LED62 to determine whether the LEDs are damaged. Specifically, in a first inspection time period P1, the controller 610 respectively provides the control signals U61-U63 at the enabling voltage level to the transistors T61-T63, so as to switch on the transistors T61-T63 to determine whether the LED61 is damaged or not according to a voltage on the anode of the LED61.

After the inspection on the LED61 is completed, in a second inspection time period P2 following the first inspection time period P1, the controller 610 respectively provides the control signals U61, U62, and U64 at the enabling voltage level to the transistors T61, T62, and T64, so as to switch on the transistors T61, T62, and T64 to determine whether the LED62 is damaged or not according to a voltage on the anode of the LED62. Here, in the first inspection time period P1 and the second inspection time period P2, the system voltage OVDD is at the high voltage level.

Specifically, in the first inspection time period P1, when the controller 610 detects that the voltage on the anode of the LED61 is the system voltage OVDD, it indicates that the LED1 at this time is in the normal state; when the controller 610 detects that the voltage on the anode of the LED61 is zero, it indicates that the LED1 at this time may be in the damaged state. Similarly, in the second inspection time period P2, when the controller 610 detects that the voltage on the anode of the LED62 is the system voltage OVDD, it indicates that the LED2 at this time is in the normal state; when the controller 610 detects that the voltage on the anode of the LED62 is zero, it indicates that the LED2 at this time may be in the damaged state. Thereby, the controller 610 can be applied to automatically and instantly detect the voltages on the anodes of the LED61 and the LED62, so as to perform the automatic inspection while there is any damage to the LED61 and the LED62 and carry out the compensation operation on the dark spots on pixels.

According to the present embodiment, note that the LED61 is inspected in the first inspection time period P1, and then the LED62 is inspected in the second inspection time period P2. However, the order of inspecting each LED is not limited in the disclosure, and it is likely to firstly inspect the LED62 and then inspect the LED61 in other embodiments of the disclosure. The illustration in FIG. 6B does not serve to pose any limitation in the disclosure.

Figure 7A:
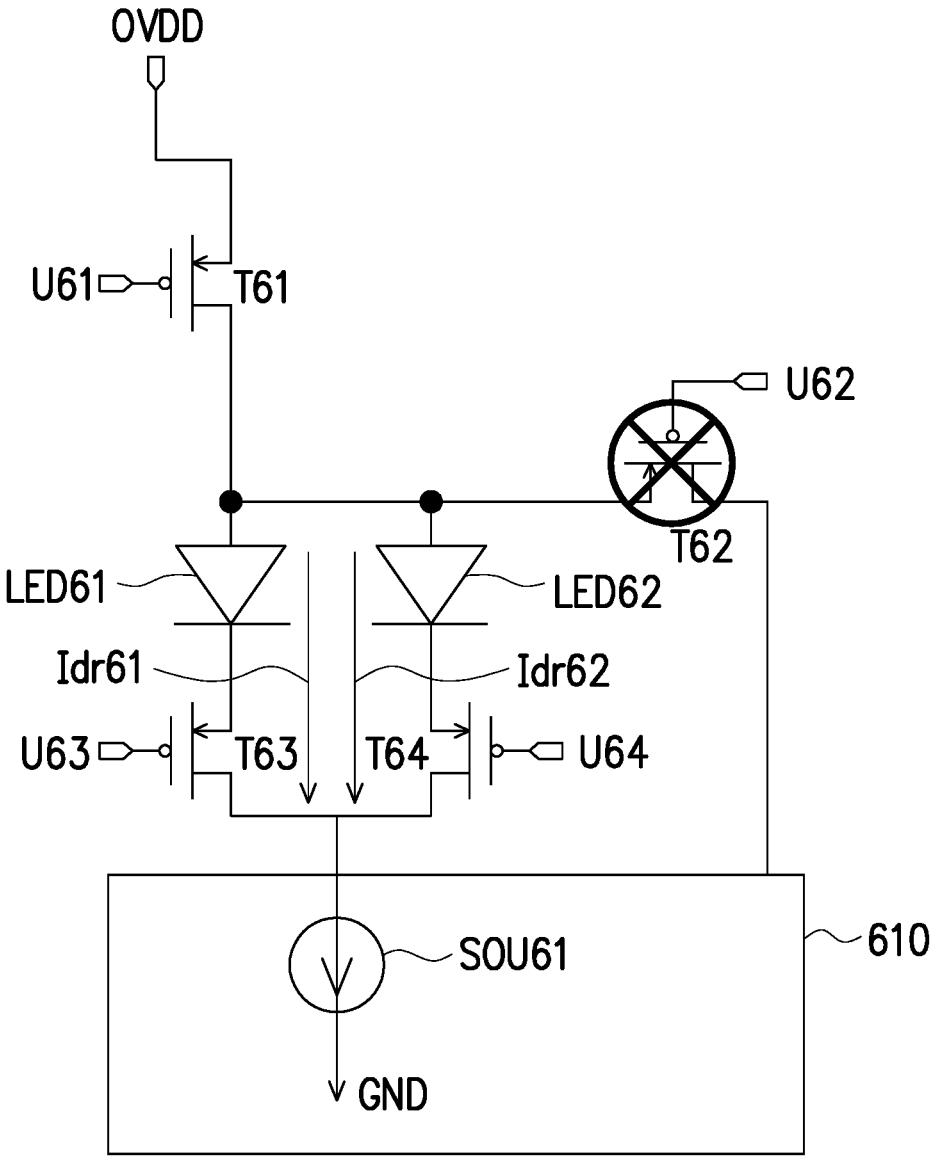
FIG. 7A to FIG. 7D schematically illustrate circuit operations of the display device depicted in FIG. 6A while the LEDs are in several states.

After that, with reference to FIG. 6A and FIG. 7A-7D, FIG. 7A to FIG. 7D schematically illustrate circuit operations of the display device depicted in FIG. 6A while the LEDs are in several states. Specifically, with reference to FIG. 6A and FIG. 7A, FIG. 7A illustrates the circuit operation of the display device depicted in FIG. 6A while the LED61 and the LED62 are both undamaged. When the controller 610 determines that the LED61 and the LED62 are both in the normal state, the transistor T61 is switched on according to the control signal U61 at the enabling voltage level, the transistor T63 is switched on according to the control signal U63 at the enabling voltage level, the transistor T64 is switched on according to the control signal U64 at the enabling voltage level, and the transistor T62 is switched off according to the control signal U62 at the disabling voltage level. Meanwhile, the controller 610 provides the electrical signal ECP3 to the first terminal of the transistor T63 and the first terminal of the transistor T64, so as to generate a driving current Idr61 and a driving current Idr62 to drive the LED1 and the LED2, wherein the electrical signal ECP3 is a drain current SOU61, one terminal of the drain current SOU61 is coupled to the first terminal of the transistor T63 and first terminal of the transistor T64, while the other terminal is coupled to the reference ground voltage GND. That is, the controller 610 at this time generates the driving current Idr61 and the driving current Idr62 through providing the drain current SOU61, whereby the driving current Idr61 switches on the LED61 and the driving current Idr62 switches on the LED62 to drive the LED61 and the LED62. Here, the driving current Idr61 and the driving current Idr62 are substantially equal, so as to enable the LED61 and the LED62 to have substantially the same brightness, whereby the display image can have the uniform brightness.

Figure 7B:
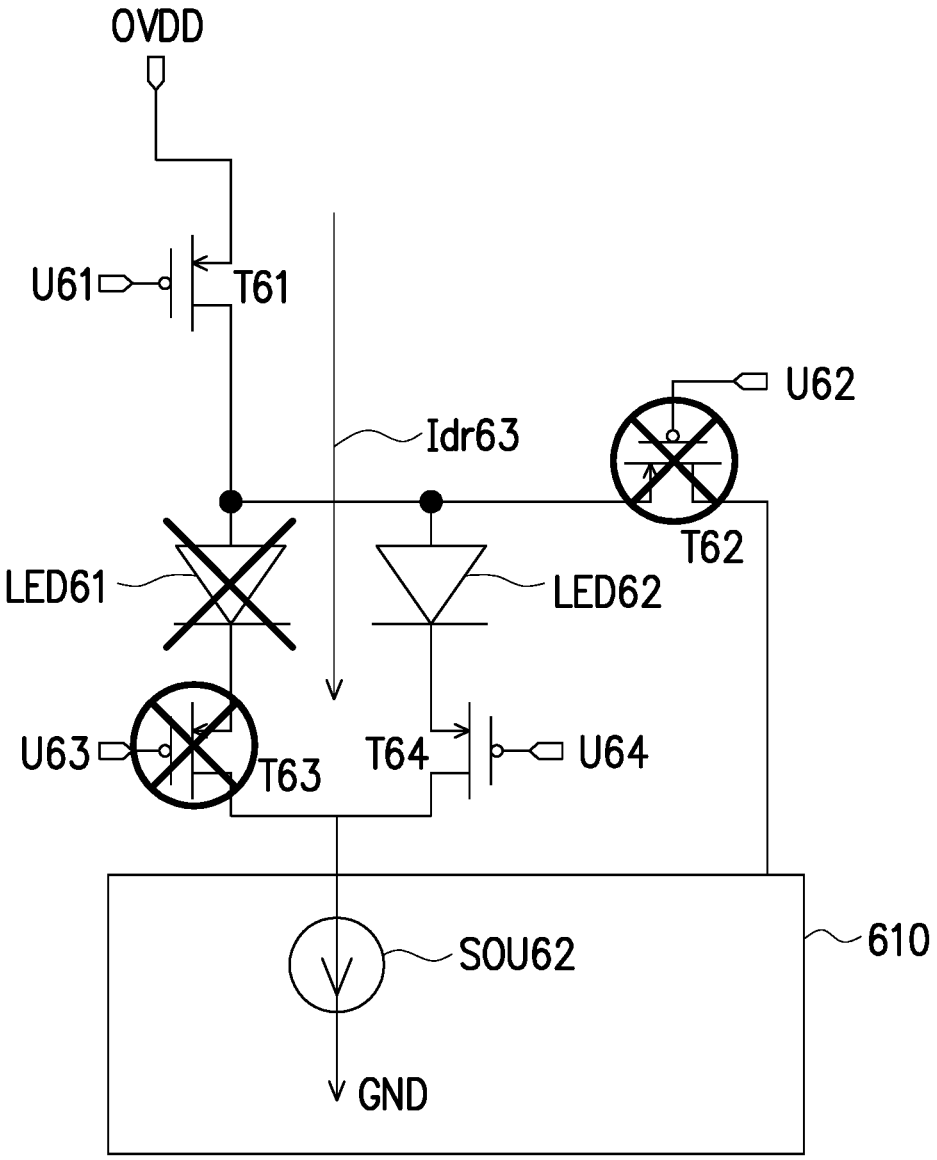

In another aspect, with reference to FIG. 6A and FIG. 7B, FIG. 7B illustrates the circuit operation of the display device depicted in FIG. 6A while the LED61 is in the damaged state. When the controller 610 determines that the LED61 is in the damaged state, and the LED62 is in the normal state, the transistor T63 is switched off according to the control signal U63 at the disabling voltage level, the transistor T61 is switched on according to the control signal U61 at the enabling voltage level, and the transistor T62 is switched off according to the control signal U62 at the disabling voltage level. At this time, the controller 610 provides the electrical signal ECP3 to the first terminal of the transistor T64, so as to generate a driving current Idr63 to drive the LED62. Note that the electrical signal ECP3 is a drain current SOU62. One terminal of the drain current SOU62 is coupled to the first terminal of the transistor T64, while the other terminal is coupled to the reference ground voltage GND.

That is, the controller 610 at this time provides the drain current SOU62, so as to generate the driving current Idr63 with the electrical signal ECP3 (i.e., the system voltage OVDD), the driving current Idr63 switches on the LED62, and the transistor T61, the LED62, the transistor T62, the transistor T64, and the controller 610 can constitute an electric current path, which allows the LED62 to perform the compensation operation on the dark spots on pixels. Note that the driving current Idr63 is greater than the driving current Idr61 and the driving current Idr62 (i.e., the driving currents while both the LED61 and the LED62 are undamaged), and thus the brightness of the LED62 herein is N times the original brightness of the LED62, wherein N is a real number.

That is, in the present embodiment, when the controller 610 determines that the LED61 is damaged, a relatively large driving current Idr63 is provided to drive the LED62, so as to ensure that the brightness of the LED62 is greater than the brightnesses of the undamaged LED61 and the undamaged LED62. Thereby, if the LED61 is damaged (i.e., the LED61 is a dark spot on pixels), the LED62 having the relatively large brightness can compensate for the brightness of the LED61 according to one or more embodiments of the disclosure, so as to maintain the brightness of the display device 600 and achieve automatic inspection of the dark spots on pixels as well as perform the compensation operation for brightness. As such, the display image can have the uniform brightness.

Figure 7C:
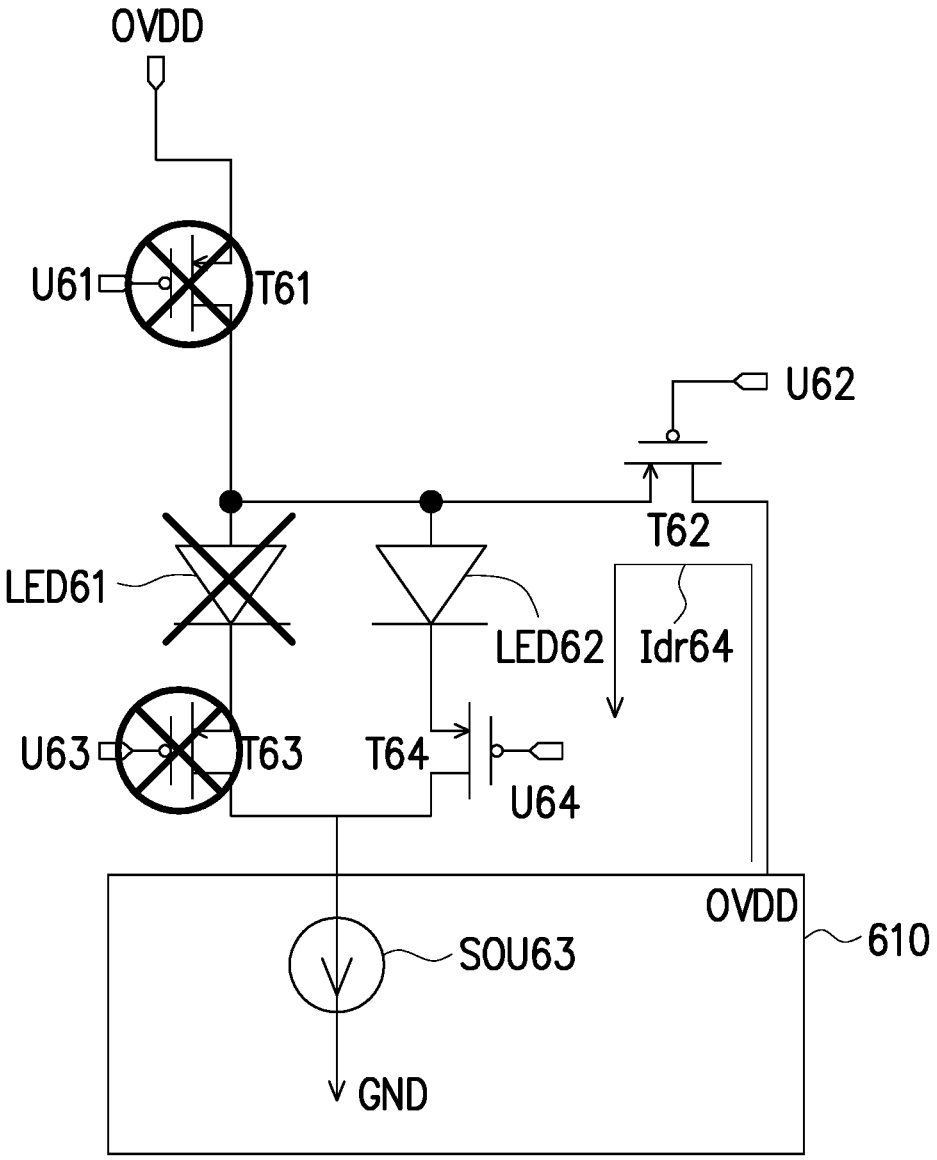

In another aspect, when the controller 610 determines that the LED61 is in the damaged state, another embodiment is provided to describe that a source current may also be applied to drive the LED62 as a compensation for the dark spots on pixels. With reference to FIG. 6A and FIG. 7C, FIG. 7C schematically illustrate the circuit operation of the display device depicted in FIG. 6A while the LED61 is in the damaged state. When the controller 610 determines that the LED61 is in the damaged state, and the LED62 is in the normal state, the transistor T61 is switched off according to the control signal U61 at the disabling voltage level, the transistor T63 is switched off according to the control signal U63 at the disabling voltage level, the transistor T62 is switched on according to the control signal U62 at the enabling voltage level, and the transistor T64 is switched on according to the control signal U64 at the enabling voltage level. At this time, the controller 610 provides the electrical signal ECP3 to the first terminal of the transistor T64 and provides the electrical signal ECP2 to the first terminal of the transistor T62, so as to generate a driving current Idr64 to drive the LED62. Here, the electrical signal ECP2 is the system voltage OVDD, and the electrical signal ECP3 is a drain current SOU63. One terminal of the drain current SOU63 is coupled to the first terminal of the transistor T64, while the other terminal is coupled to the reference ground voltage GND.

That is, the controller 610 at this time generates the driving current Idr64 by providing the system voltage OVDD and the source current SOU63 and enables the driving current Idr64 to switch on the LED62, so that the transistor T62, the LED62, the transistor T64, and the controller 610 can constitute a driving loop. Note that the driving current Idr64 is also greater than the driving currents Idr61 and Idr62, and thus the brightness of the LED62 is N times the original brightness of the LED62 for compensating for the brightness of the dark spots on pixels.

Figure 7D:
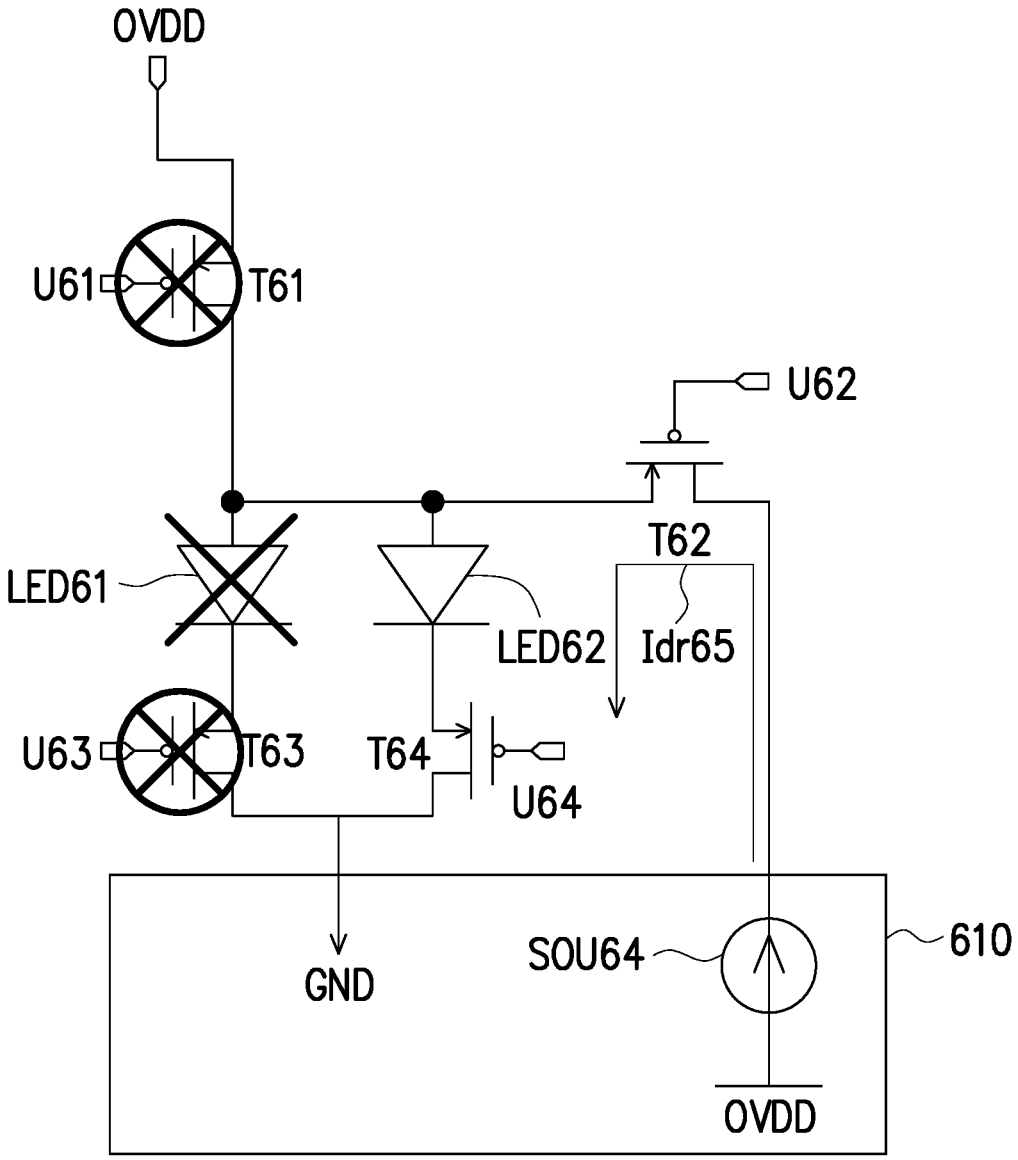

When the controller 610 determines that the LED61 is in the damaged state, it should be mentioned that a source current may also be applied to drive the LED62 as a compensation for the dark spots on pixels. Please refer to FIG. 6A and FIG. 7D. FIG. 7D illustrates the circuit operation of the display device depicted in FIG. 6A while the LED61 is in the damaged state according to another embodiment of the disclosure. When the controller 610 determines that the LED61 is in the damaged state, and the LED62 is in the normal state, the transistor T61 is switched off according to the control signal U61 at the disabling voltage level, the transistor T63 is switched off according to the control signal U63 at the disabling voltage level, the transistor T62 is switched on according to the control signal U62 at the enabling voltage level, and the transistor T64 is switched on according to the control signal U64 at the enabling voltage level. Meanwhile, the controller 610 provides the electrical signal ECP3 to the first terminal of the transistor T64 and provides the electrical signal ECP2 to the first terminal of the transistor T62, so as to generate a driving current Idr65 to drive the LED62. Note that the electrical signal ECP3 is the reference ground voltage GND, and the electrical signal ECP2 is a source current SOU64. One terminal of the source current SOU64 is coupled to the first terminal of the transistor T62, and the other terminal of coupled to the system voltage OVDD.

That is, the controller 610 at this time generates the driving current Idr65 by providing the system voltage OVDD and the source current SOU64 and enables the driving current Idr65 to switch on the LED62, so that the transistor T62, the LED62, the transistor T64, and the controller 610 can constitute a driving loop. Note that the driving current Idr65 is also greater than the driving currents Idr61 and Idr62, and thus the brightness of the LED62 is N times the original brightness of the LED62 for compensating for the brightness of the dark spots on pixels.

According to the present embodiment, it should be mentioned that when the LED62 in the display device 600 is in the damaged state, and the LED61 is in the normal state, the compensation operation performed on the dark spots on pixels and the circuit operations described herein are similar to those provided in the previous embodiment, i.e., when the LED62 is in the normal state and the LED61 is in the damaged state; therefore, no further explanation is provided hereinafter. Besides, note that the circuit structures provided in the previous embodiments depicted in FIG. 3A, FIG. 4, and FIG. 5 can also be formed in the display device 600 provided in the present embodiment; hence, people having ordinary skill in the art can apply the circuit structures, the circuit properties, and the automatic inspection and compensation for the dark spots on pixels provided in the embodiments depicted in FIG. 3A, FIG. 4, and FIG. 5 to the display device 600 provided in the present embodiment according to the descriptions of the display devices 300, 400, and 500; therefore, no further explanation is provided hereinafter.

Figure 8:
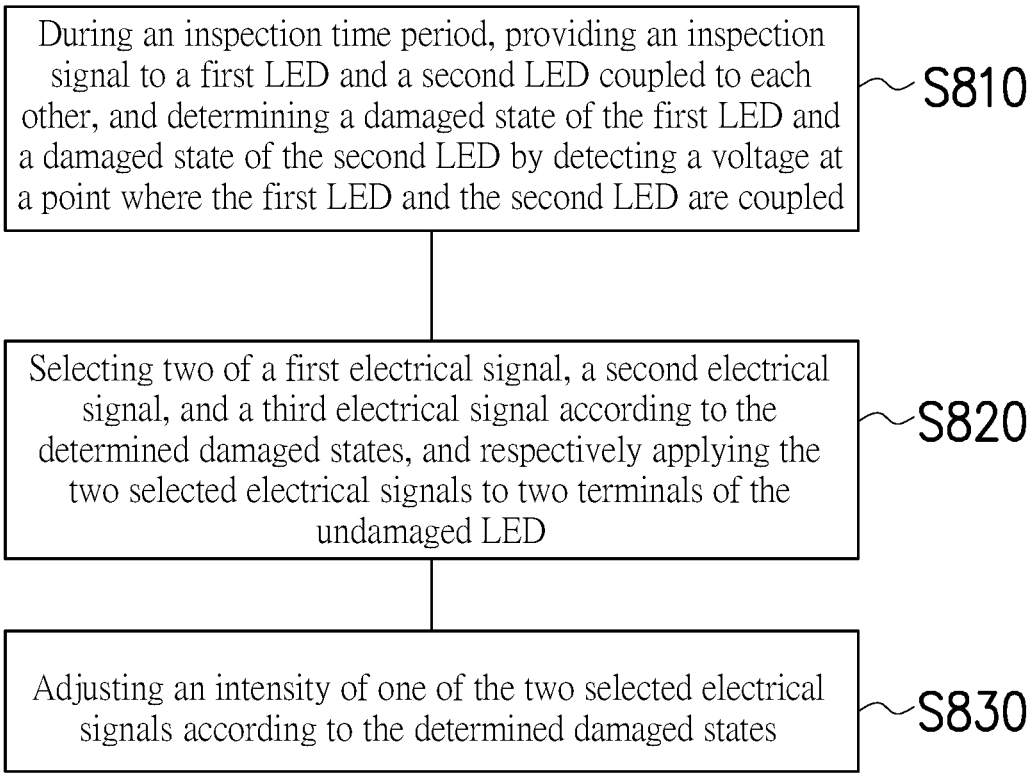
FIG. 8 is a flow chart of an operating method of a display device according to an embodiment of the disclosure.

With reference to FIG. 8, FIG. 8 is a flow chart of an operating method of a display device according to an embodiment of the disclosure. First, in step S810, during an inspection time period, an inspection signal is provided to a first LED and a second LED coupled to each other, and a damaged state of the first LED and a damaged state of the second LED are determined by detecting a voltage at a point where the first LED and the second LED are coupled, wherein the inspection signal is, for instance, a first electrical signal. In step S820, two of the first electrical signal, a second electrical signal, and a third electrical signal are selected according to the determined damaged states, and the two selected electrical signals are respectively applied to two terminals of the undamaged LED. In step S830, an intensity of one of the two selected electrical signals is adjusted according to the determined damaged states.

Note that the implementation details of the steps S810 to S830 are elaborated in the previous embodiments, and therefore no further explanation is provided hereinafter.

To sum up, in one or more embodiments of the disclosure, the display device controls a plurality of switches through the first controller, so as to detect the first LED and the second LED and determine whether the first LED and the second LED are damaged or not (i.e., determine whether there is any damage to the LEDs, thus leading to the dark spots on pixels), and a plurality of control signals, the second electric signal, and the third electric signal are provided to the switches according to the damaged states of the first LED and the second LED, so as to compensate for the LEDs. As such, the effects of automatic inspection and compensation for the dark spots on the pixels can be achieved, and the brightness of the display image is uniform.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device comprising:

a first light emitting diode;

a first switch, a first terminal of the first switch receiving a first electrical signal, a second terminal of the first switch being coupled to an anode of the first light emitting diode;

a second switch, a first terminal of the second switch receiving a second electrical signal, a second terminal of the second switch being coupled to a cathode of the first light emitting diode;

a second light emitting diode, an anode of the second light emitting diode being coupled to the cathode of the first light emitting diode;

a third switch, a first terminal of the third switch receiving a third electrical signal, a second terminal of the third switch being coupled to a cathode of the second light emitting diode, wherein whether the first switch, the second switch, and the third switch are switched on or off is determined by whether the first light emitting diode and the second light emitting diode are damaged or not; and a first controller configured to detect whether the first light emitting diode and the second light emitting diode are damaged or not, generate the second electrical signal and the third electrical signal, and generate a plurality of control signals controlling the first switch to the third switch, wherein when the first controller determines the first light emitting diode and the second light emitting diode are undamaged, the first switch and the third switch are switched on, the second switch is switched off, and the first controller provides the third electrical signal to the first terminal of the third switch to generate a first driving current to drive the first light emitting diode and the second light emitting diode, wherein the third electrical signal is a drain current.

2. The display device according to claim 1, wherein the first controller enables the first switch to the third switch to be switched on and determines whether the first light emitting diode and the second light emitting diode are damaged or not according to a voltage on the cathode of the first light emitting diode.

3. The display device according to claim 1, wherein when the first controller determines the first light emitting diode is in a damaged state, the second switch and the third switch are switched on, the first switch is switched off, and the first controller provides the third electrical signal to the first terminal of the third switch and provides the second electrical signal to the first terminal of the second switch, so as to generate a second driving current to drive the second light emitting diode, wherein the third electrical signal is the drain current, the second electrical signal is a system voltage, and the second driving current is greater than the first driving current.

4. The display device according to claim 1, wherein when the first controller determines the first light emitting diode is in a damaged state, the second switch and the third switch are switched on, the first switch is switched off, and the first controller provides the third electrical signal to the first terminal of the third switch and provides the second electrical signal to the first terminal of the second switch, so as to generate a second driving current to drive the second light emitting diode, wherein the third electrical signal is a reference ground voltage, the second electrical signal is a source current, and the second driving current is greater than the first driving current.

5. The display device according to claim 1, wherein when the first controller determines the second light emitting diode is in a damaged state, the first switch and the second switch are switched on, the third switch is switched off, and the first controller provides the second electrical signal to the first terminal of the second switch to generate a second driving current to drive the first light emitting diode, wherein the second electrical signal is the drain current, and the second driving current is greater than the first driving current.

6. The display device according to claim 1, further comprising:

at least one third light emitting diode;

at least one fourth switch, a first terminal of the at least one fourth switch receiving the first electrical signal, a second terminal of the at least one fourth switch being coupled to an anode of the at least one third light emitting diode;

at least one fifth switch, a first terminal of the at least one fifth switch receiving the second electrical signal, a second terminal of the at least one fifth switch being coupled to a cathode of the at least one third light emitting diode;

at least one fourth light emitting diode, an anode of the at least one fourth light emitting diode being coupled to the cathode of the at least one third light emitting diode; and at least one sixth switch, a first terminal of the at least one sixth switch receiving the third electrical signal, a second terminal of the at least one sixth switch being coupled to a cathode of the at least one fourth light emitting diode, wherein whether the at least one fourth switch, the at least one fifth switch, and the at least one sixth switch are switched on or off is determined by whether the at least one third light emitting diode and the at least one fourth light emitting diode are damaged or not.

7. The display device according to claim 6, wherein the first controller detects whether the at least one third light emitting diode and the at least one fourth light emitting diode are damaged or not, generates the second electrical signal and the third electrical signal, and generates a plurality of control signals controlling the at least one fourth switch to the at least one sixth switch, wherein a light emitting wavelength of the first light emitting diode and a light emitting wavelength of the second light emitting diode are equal, the light emitting wavelength of the first light emitting diode and a light emitting wavelength of the at least one third light emitting diode are different, and the light emitting wavelength of the first light emitting diode and a light emitting wavelength of the at least one fourth light emitting diode are different.

8. The display device according to claim 6, further comprising:

a second controller configured to detect whether the at least one third light emitting diode and the at least one fourth light emitting diode are damaged or not, generate the second electrical signal and the third electrical signal, and generate a plurality of control signals controlling the at least one fourth switch to the at least one sixth switch, wherein the first controller and the second controller are coupled to each other, and a light emitting wavelength of the first light emitting diode, a light emitting wavelength of the second light emitting diode, a light emitting wavelength of the at least one third light emitting diode, and a light emitting wavelength of the at least one fourth light emitting diode are equal.

9. The display device according to claim 8, wherein when the first controller determines at least one of the first light emitting diode and the second light emitting diode is in a damaged state, the first controller transmits a compensation signal to the second controller, and the second controller provides the control signals to the at least one fourth switch to the at least one sixth switch according to the compensation signal, so as to generate a second driving current to drive the at least one third light emitting diode and the at least one fourth light emitting diode, wherein the second driving current is greater than the first driving current.

10. An operating method of a display device, comprising:

during an inspection time period, providing an inspection signal to a first light emitting diode and a second light emitting diode coupled to each other and determining a damaged state of the first light emitting diode and a damaged state of the second light emitting diode by detecting a voltage at a point where the first light emitting diode and the second light emitting diode are coupled;

selecting two of a first electrical signal, a second electrical signal, and a third electrical signal according to the determined damaged states and applying the two selected electrical signals respectively to two terminals of the undamaged light emitting diode; and adjusting an intensity of one of the two selected electrical signals according to the determined damaged states.

11. The operating method according to claim 10, wherein the inspection signal is the first electrical signal, and the first electrical signal is a system voltage.

12. The operating method according to claim 10, wherein the damaged states comprise a first light emitting diode damaged state, a second light emitting diode damaged state, and an undamaged state.

13. The operating method according to claim 12, wherein when the damaged state of the first light emitting diode and the damaged state of the second light emitting diode are determined to be the undamaged states, the third electrical signal is set as a drain current, the first electrical signal is set as a system voltage, the first electrical signal is applied to an anode of the first light emitting diode, and the third electrical signal is applied to a cathode of the second light emitting diode; and adjusting an intensity of the third electrical signal as a first signal intensity.

14. The operating method according to claim 13, wherein when the damaged state of the first light emitting diode and the damaged state of the second light emitting diode are determined to be the first light emitting diode damaged states, the second electrical signal is set as a source current, the third electrical signal is set as a reference ground voltage, and the second electrical signal and the third electrical signal are respectively applied to two terminals of the second light emitting diode; and adjusting an intensity of the second electrical signal as a second signal intensity, wherein the second signal intensity is greater than the first signal intensity.

15. The operating method according to claim 13, wherein when the damaged state of the first light emitting diode and the damaged state of the second light emitting diode are determined to be the first light emitting diode damaged states, the second electrical signal is set as the system voltage, the third electrical signal is set as the drain current, and the second electrical signal and the third electrical signal are respectively applied to two terminals of the second light emitting diode; and adjusting an intensity of the third electrical signal as a second signal intensity, wherein the second signal intensity is greater than the first signal intensity.

16. The operating method according to claim 13, wherein when the damaged state of the first light emitting diode and the damaged state of the second light emitting diode are determined to be the second light emitting diode damaged states, the second electrical signal or the third electrical signal is set as the drain current, the first electrical signal is set as the system voltage, the first electrical signal is applied to an anode of the first light emitting diode, and the second electrical signal or the third electrical signal is applied to a cathode of the first light emitting diode; and adjusting an intensity of the second electrical signal or the third electrical signal as a second signal intensity, wherein the second signal intensity is greater than the first signal intensity.

* * * * *